US011433560B2

(12) United States Patent
Giles

(10) Patent No.: US 11,433,560 B2
(45) Date of Patent: Sep. 6, 2022

(54) DRYWALL KNIFE

(71) Applicant: Vincent Leon Giles, Stoney Creek (CA)

(72) Inventor: Vincent Leon Giles, Stoney Creek (CA)

( * ) Notice: Subject to any disclaimer, the term of this patent is extended or adjusted under 35 U.S.C. 154(b) by 0 days.

(21) Appl. No.: 16/784,303

(22) Filed: Feb. 7, 2020

(65) Prior Publication Data

US 2021/0245374 A1 Aug. 12, 2021

(51) Int. Cl.
*B26B 1/10* (2006.01)
*B26B 1/08* (2006.01)

(52) U.S. Cl.
CPC . *B26B 1/10* (2013.01); *B26B 1/08* (2013.01)

(58) Field of Classification Search
CPC ..... B26B 1/08; B26B 1/10; B26B 5/00–007
USPC ..... 30/162; D8/99; 33/42
See application file for complete search history.

(56) References Cited

U.S. PATENT DOCUMENTS 2,676,406 A 4/1954 Hoke
D238,247 S * 12/1975 Thomas, III ..... B26B 5/002 D8/99
4,255,856 A 3/1981 Mackie
4,322,885 A 4/1982 Osada
4,729,168 A 3/1988 Yeh
5,012,581 A 5/1991 Fletcher
5,289,637 A 3/1994 Coffey
5,406,711 A * 4/1995 Graham ..... B25H 7/02 33/42
5,584,123 A * 12/1996 Chi ..... B26B 5/001 30/162
5,794,350 A * 8/1998 Shand ..... B26B 29/02 30/162
5,806,189 A * 9/1998 Bailey ..... B26B 5/001 30/162
D399,721 S * 10/1998 Torre ..... D8/99
(Continued)

FOREIGN PATENT DOCUMENTS

FR 2854588 11/2004
KR 200337207 12/2003
WO WO-2021155464 A1 * 8/2021 ..... B26B 1/08

OTHER PUBLICATIONS

CH Hanson Flip Knife, http://www.blastlineind.com/product-p/05c03015.htm.

(Continued)

*Primary Examiner* — Jason Daniel Prone
(74) *Attorney, Agent, or Firm* — Sand, Sebolt & Wernow Co., LPA

(57) ABSTRACT

A utility knife, a blade member for use therewith, and a method of using the same; The knife has an ergonomically designed, symmetrical handle with resilient grips for a user's palm and fingers provided on opposing top and bottom walls of the housing. The blade member has two opposed cutting surfaces aligned with the housings top and bottom walls. A tape engagement clip is provided on a leading end of the knife and secures a free end of the measuring tape to the knife. The knife may be gripped and used in two different orientations located 180 degrees apart. The tape engagement clip pivots to enable the free end of the measuring tape to be secured to the knife regardless of which cutting surface is used to cut an article. Alternatively, the clip may be moved to the opposing side wall of the knife.

19 Claims, 25 Drawing Sheets

(56) References Cited

U.S. PATENT DOCUMENTS

| | | | | |
|---|---|---|---|---|
| 5,878,501 | A | 3/1999 | Owens et al. | |
| 6,006,433 | A * | 12/1999 | Baltazar | B26B 5/001 30/162 |
| 6,330,749 | B1 * | 12/2001 | Khachatoorian | B26B 5/001 30/162 |
| 6,446,341 | B1 * | 9/2002 | Wang | B26B 5/00 30/161 |
| 6,775,912 | B2 * | 8/2004 | Panfili | B26B 5/001 30/162 |
| D497,301 | S * | 10/2004 | Kondo | D8/99 |
| 6,848,185 | B2 | 2/2005 | Tebo | |
| 6,912,799 | B1 * | 7/2005 | Smith | B25H 7/04 33/42 |
| 6,948,250 | B1 * | 9/2005 | Caiafa, Jr. | B26B 1/08 30/162 |
| 7,562,455 | B2 * | 7/2009 | McHenry | B26B 1/08 30/162 |
| 7,565,747 | B2 * | 7/2009 | Cobb | B26B 5/001 30/329 |
| 7,647,702 | B2 * | 1/2010 | Polei | B26B 5/001 30/162 |
| 7,797,838 | B2 * | 9/2010 | Chu | B26B 1/08 30/162 |
| 8,001,641 | B1 * | 8/2011 | Williams | B26B 5/00 30/162 |
| 8,020,306 | B2 * | 9/2011 | Grivas | B25H 7/04 33/42 |
| 8,020,312 | B1 * | 9/2011 | McGahan | B26B 29/06 33/42 |
| 8,171,646 | B2 * | 5/2012 | Chiu | B26B 5/006 30/169 |
| 8,245,753 | B2 * | 8/2012 | Haemerle | B26B 5/00 30/156 |
| 8,701,293 | B2 * | 4/2014 | Sullivan | B26B 1/10 30/162 |
| 8,739,414 | B2 | 6/2014 | Tyers | |
| 8,819,954 | B1 * | 9/2014 | Fernandez | G01B 3/1071 33/42 |
| 8,997,358 | B2 | 4/2015 | Huang | |
| 10,124,495 | B2 | 11/2018 | Gallegos et al. | |
| 10,343,294 | B2 | 7/2019 | Garavaglia et al. | |
| 10,427,311 | B2 | 10/2019 | Nguyen et al. | |
| 10,478,977 | B2 * | 11/2019 | Rohrbach | B26B 5/001 |
| 10,589,436 | B1 * | 3/2020 | Panosian | B26B 5/003 |
| 11,076,738 | B2 * | 8/2021 | Scimone | B26B 5/001 |
| 2006/0130338 | A1 * | 6/2006 | Dzubak | B26B 5/003 30/162 |
| 2007/0209208 | A1 | 9/2007 | Dunn-Rankin | |
| 2009/0038160 | A1 * | 2/2009 | Pomerantz | B26B 5/00 30/162 |
| 2011/0308092 | A1 * | 12/2011 | Lin | B26B 5/002 30/164 |
| 2013/0081281 | A1 * | 4/2013 | Chu | B26B 1/08 30/162 |
| 2016/0046026 | A1 * | 2/2016 | Ranieri | B26B 5/001 30/162 |
| 2021/0323178 | A1 * | 10/2021 | Marovic | B26B 5/003 |

OTHER PUBLICATIONS

Dewalt DWHT10035L, https://www.dewalt.com/products/hand-tools/knives-and-blades/folding-retractable-utility-knife/dwht10035.

Gardner Bender RKT 21, https://www.electricbargainstores.com/product-p/gardner-bender-rkt-21.htm.

Irwin Tools 1774103, https://www.irwin.com/tools/utility-knives-blades/drywall-fixed-utility-knife.

Milwaukee Fastback II, https://www.milwaukeetool.com/Products-Repository/North-America/Hand-Tools/Knives/48-22-1902.

OLFA 5003 L-1, https://www.grainger.com/product/OLFA-Snap-Off-Knife-5LC34?ef_id=EAIaIQobChMI_77o6eK95wIVzsDACh3_lwDXEAAYASAAEgJ5OfD_BwE:G:s&s_kwcid=AL!2966!3!317451746049!b!!g!!&cm_mmc=PPC:+Google+PPC.

Stanley Dynagrip, https://www.stanleytools.com/products/hand-tools/knives-blades/utility-knives/6-in-dynagrip-retractable-utility-knife/10-779.

The Drywall Axe, https://www.amazon.com/Drywall-Axe-Measuring-Utility-Knife/dp/B082KFW1MD.

* cited by examiner

DRYWALL KNIFE

TECHNICAL FIELD

This disclosure is directed to hand-held cutting tools. More particularly, this disclosure is directed a utility knife. Specifically, the disclosure relates to a utility knife with an ergonomically designed handle having resilient grips for a user's palm and fingers and configured to hold a blade member with two opposed cutting surfaces. A tape engagement clip is provided on a leading end of the knife and is arranged to secure a free end of a measuring tape to the knife. The knife may be gripped and used in two different orientations that are located 180 degrees apart. The tape engagement clip is able to pivot to enable the free end of the measuring tape to be secured to the knife regardless of which cutting surface is being used to cut an article.

BACKGROUND

Background Information

Utility knives are used for a variety of different uses. Utility knives may use fixed, folding, retractable, or replaceable blades and tend to come in a wide variety of lengths and styles suited to the particular set of tasks they are designed to perform. Presently known utility knives tend to fall into one of three categories. A first category is a foldable knife in which a single blade is pivotally engaged with a handle. The blade is pivoted between a use position and a folded position. In the use position, the blade extends forwardly from a front end of the handle and is able to be used to cut an object. When in the folded position, the blade is moved into a position where it lays in abutting contact with at least a part of the handle. In this folded position, the blade can no longer be used for cutting objects. These types of utility knives are useful for only a narrow range of tasks and have to be handled carefully as the person needs to grasp the blade to move it between the use position and the folded position. These types of knives may be suitable for use as camping or outdoor knives or as box cutters.

A second category of utility knife is a fixed-blade knife. Knives in this category have a handle with a blade extending outwardly and forwardly therefrom. The blade cannot be retracted or pivoted relative to the handle. Fixed-blade knives may be used for crafts and various hobbies. In other instances, the blade may be quite substantial and can be used as a hunting knife, for example. In these instances, the blade will typically be selectively coverable with some type of sheath when the knife is not in use. The sheath will help to prevent the cutting surface of the blade from being accidentally contacted and will thereby protect the person from accidental cuts. The sheath may also help to prevent the blade from coming into contact with objects that might damage the cutting surface.

A third category of utility knife is a retractable knife. In these knives, the blade is mounted on some type of sliding mechanism that allows a person to move the blade between a use position and a storage position. In the use position, at least a leading end of the blade projects forwardly from the handle. In the storage position, substantially the entire blade is moved into a cavity defined within the handle. The person is able to select the degree to which the blade is moved outwardly from the handle or inwardly into the handle. This type of knife is commonly used in the construction industry for performing tasks such as cutting sheets of drywall. Utility knives used in the construction industry tend to fall into three groups that have retractable and replaceable blades made of die-cast metal.

A first group of this third category of utility knife have blades that comprise an elongated strip made up of a plurality of segments which are separated from each other by lines of weakness. A plurality of these angled lines of weakness is provided at intervals along the strip. A bottom edge of the strip is sharpened and comprises a cutting surface of the blade. At least the first segment of the strip can be extended outwardly from a front end of the knife handle. The rest of the strip remains within the interior of the handle. The leading end of the strip, i.e., the first segment thereof, presents a first portion of the cutting surface and can be used to cut objects. When the cutting surface on the first segment becomes dull, the person is able to snap the first segment of the strip from the rest of the strip. A second segment of the strip then become a new leading end that may be extended outwardly from the handle. The second segment also include a second portion of the sharp cutting surface of the strip and can therefore be used to cut objects. When the cutting surface on the second segment becomes dulled, that second segment is snapped off the rest of strip and a third segment of the strip become the leading end, and so on. A plurality of these blade strips may be stored in the knife handle or the handle may be opened to reload a new strip when the original strip has been used up and discarded.

A second group of the third category of utility knives have blades that are generally trapezoidal in shape. The blades has a bottom edge that is sharpened into a cutting surface. The blades present a first angled end that extends in a first direction and a second angled end that extends in a second direction. The knife handle may be opened and one of these blades may be engaged with a sliding mechanism. When the blade is engaged, the handle is closed around the blade and the sliding mechanism may be operative to extend one of the first angled end and the second angled end outwardly from the handle housing. When the cutting surface on the first angled end or the second angled end becomes dull, the person will open the handle to gain access to the interior, will disengage the blade from the sliding mechanism, and will rotate the blade through 180 degrees. The blade will be reengaged with the sliding mechanism and the handle will be closed up again. The person may then operative the sliding mechanism to extend the other of the first and second angled ends outwardly from the housing. When the cutting surface on the other of the first and second angled ends becomes dull, the person will open up the handle, disengage the blade from the sliding mechanism, and then discard the blade. A new blade (which may be stored in the handle) is then engaged with the sliding mechanism, the handle is closed up again, and the utility knife may be used as previously described.

The knives of either of these two groups discussed above allow the person to adjust how far the blade extends outwardly from the handle so that the knife can safely be used for selected purposes. The knives can be used for tasks such as cutting tape sealing a package, cutting open sealed plastic packaging, or cutting drywall. As discussed above, if the blade becomes dull it can be quickly reversed or switched for a replacement blade. Spare or used blades may be stored in the hollow handle of some models and can be readily accessed if needed. Other knife models have a quick-change mechanism that allows the blades to be replaced without the use of additional tools. Specialized knives also exist for cutting string, linoleum, and other materials.

A third group of the third category of utility knives includes a simple sleeve that is provided around a rectangular handle and into which a single-edge utility blade may be inserted. The sleeve slides along the handle, holding the blade in place during use and covering the blade when it is not in use. The blade holder may retract or fold into the handle, much like a folding-blade pocketknife. The blade holder is designed to expose just enough cutting surface as to enable the knife to cut through a single layer of corrugated fiberboard, for example, so as to minimize the chances of damaging the contents inside a cardboard box.

As indicated earlier herein, one of the tasks for which utility knives are used is cutting drywall sheets. Do-it-yourself enthusiasts may use a tape measure, pencil, and square or ruler to mark a line along the surface of a sheet of drywall. They will then extend a blade outwardly from the handle of one of the types of utility knife described herein and will use the blade thereof to cut the sheet of drywall. In some instances, they will also use a ruler or set square as a cutting guide to help keep them moving the blade along the marked line.

This is not how drywall professionals tend to cut drywall sheets. Professional drywall installers usually hold a utility knife in one hand and the end of a measuring tape is hooked over the thumb on the hand that is holding the knife. With the other hand they lock the tape at the correct distance and hook and slide the tape across the edge of the drywall sheet while simultaneously cutting the drywall. While this, at first glance, would seem to be a relatively simply operation, it takes years of practice to perfect the technique and cut drywall sheets at the desired location and to the correct size.

SUMMARY

A utility knife, a blade member for use therewith, and a method of using the same; The knife has an ergonomically designed, symmetrical handle with resilient grips for a user's palm and fingers provided on opposing first and second walls of the housing. The blade member has two opposed cutting surfaces aligned with the housings first and second walls. A tape engagement clip is provided on a leading end of the knife and secures a free end of a measuring tape to the knife. The knife may be gripped and used in two different orientations located 180 degrees apart. The tape engagement clip pivots to enable the free end of the measuring tape to be secured to the knife regardless of which cutting surface is used to cut an article. Alternatively, the clip may be moved to the opposing side wall of the knife.

The present disclosure is directed to a retractable, replaceable blade which has a unique shape that increases the cutting life of the blade. The blade is a snap-off style blade with two edges and a dedicated shape. The disclosure is also directed to a utility knife that is configured to receive the disclosed blades. The disclosure is further directed to a utility knife that is particularly useful for tasks such as cutting drywall. The utility knife in accordance with the present disclosure includes a tape engagement mechanism that enables a person to lock an end of a tape from a measuring tape with the knife. The tape engagement mechanism includes a swivel that helps to eliminate misalignment between the tape and knife. The knife also has rubber grips on its ergonomically designed handle and be used by both left handed and right handed persons.

In one aspect, an exemplary embodiment of the present disclosure may provide a utility knife comprising a housing having a first end and a second end, and a longitudinal axis extending therebetween; said housing defining an interior cavity that is accessible through an opening defined in the first end; a blade member received in the interior cavity and being selectively movable relative to the first end between a retracted position and an extended position; and when in the extended position, a portion of the blade member extends outwardly through the opening and beyond the first end. The housing has a first housing section with; and a first side wall and a pair of second side wall sections that each extend from the first end to the second end. The first housing section has a midline that is parallel to the longitudinal axis, and the first side wall of the first housing section is substantially symmetrical about the midline. In an exemplary embodiment, the housing may further include a first wall and an opposed second wall that extend between the first side wall and the second side wall sections from the first end to the second end, and wherein the first wall and the second wall are substantially identical to each other and are arranged as mirror images of each other. In an exemplary embodiment, each of the first wall and the second wall may define a projection that extends outwardly for a greater distance from the midline than a rest of the first wall and the second wall, respectively, and wherein each projection includes a an angled surface that extends from an apex of the projection towards the first end of the housing; and wherein the angled surface is adapted to selectively receive a thumb pad of a user of the utility knife thereon. In an exemplary embodiment a first overmold may be provided on the first wall; and a second overmold may be provided on the second wall; and each of the first overmold and the second overmold may comprise a resilient material. In an exemplary embodiment each of the first overmold and the second overmold may have alternating ribs and spaces, wherein the ribs are of varying heights and are arranged as a series of undulating hills and valleys.

In another aspect, an exemplary embodiment may further comprise a tape engaging clip provided on one of the first side wall and the second side wall of the second housing section wherein the tape engaging clip defines a passage therein, and wherein the passage is adapted to selectively receive a portion of a free end of a measuring tape therein. In an exemplary embodiment, the tape engaging clip may be selectively rotatable about an axis that is oriented at right angles to the longitudinal axis of the housing.

In another aspect, the blade member utilized with the utility knife may have a first edge and a second edge that are aligned with the first wall and the second wall of the housing, respectively, and at least a portion of each of the first edge and the second edge is sharpened to form a cutting surface. In an exemplary embodiment, the blade member may have a first end and an opposed second end that extend between the first edge and the second edge; and the blade member has a midline that is substantially equidistant from the first edge and the second edge; and the blade member is symmetrical about the blade member's midline. In an exemplary embodiment, the first end of the blade member may include a first tip proximate an intersection of the first end and the first edge and a second tip at an intersection of the first end and the second edge, and wherein the first tip and second tip are substantially identical in shape. In an exemplary embodiment, the first tip and the second tip may each be an inverted V-shape and extend outwardly from blade member in generally the same direction. In an exemplary embodiment, the first tip and the second tip may be substantially J-shaped, and the first tip and the second tip may be arranged on the blade member as mirror images of each other.

In another aspect, an exemplary embodiment of the present disclosure may provide a blade member for a utility knife comprising a planar member having a first end and a second end opposed to the first end; a first edge and a second edge opposed to the first edge; wherein the first edge and the second edge extend between the first end and the second end; and a first side and a second side opposed to the first side; wherein the first side and the second side extend between the first edge and the second edge; wherein at least a portion of the first edge is sharpened into a first cutting surface; and wherein at least a portion of the second edge is sharpened into a second cutting surface.

In an exemplary embodiment each of the first side and second side of the planar member may have a midline that is generally equidistant from the first edge and the second edge, and the planar member may be is substantially symmetrical about the midline. In one exemplary embodiment one or more lines of weakness may be defined in the first side and the second side of the planar member and may extend between the first cutting surface and the second cutting surface, wherein each of the one or more lines of weakness may be substantially identical in shape to the first end of the planar member. In an exemplary embodiment the planar member may include a first tip defined proximate an intersection of the first end and the first edge and a second tip defined proximate an intersection of the first end and the second edge. In an exemplary embodiment, the first tip and the second tip may be identical in shape and extend generally in the same direction. In an exemplary embodiment, the first tip and the second tip may be identical in shape and arranged as mirror images of each other.

In another aspect, and exemplary embodiment of the present disclosure may provide a method of cutting a drywall sheet comprising moving a blade member longitudinally along a longitudinal axis of a utility knife housing from a retracted position to an extended position; providing a first cutting surface and a second cutting surface along opposed first and second edges of the blade member; gripping the utility knife housing in either of a first orientation or a second orientation in either of a user's left hand or right hand of the user; cutting the drywall sheet with the first cutting surface when the utility knife housing is held in the first orientation and cutting the drywall sheet with the second cutting surface when the utility knife housing is held in the second orientation, where the first orientation and second orientation are 180 degrees apart from each other.

In an exemplary embodiment the method may further comprise securing a free end of a measuring tape to a tape engagement clip provided on a leading end of the utility knife housing. The method may further comprise extending a length of the measuring tape outwardly from a measuring tape housing and holding the measuring tape housing a distance outwardly from the utility knife and adjacent a surface of an article, and cutting the article with one of the first cutting surface or the second cutting surface. In an exemplary embodiment the method may include pivoting the tape engagement clip through 180 degrees when the utility knife housing is moved from the first orientation to the second orientation. In an exemplary embodiment, the securing may be temporary. In one embodiment the method may include engaging the tape engaging clip with one of a first side wall and a second side wall of the leading end of the second housing section of the utility knife housing and moving the tape engaging clip to the other of the first side wall and the second side wall of the second housing section prior to moving the utility knife housing from the first orientation to the second orientation and vice versa. In one embodiment the securing may include inserting a vertical leg of the free end of the measuring tape into a passage defined in the tape engaging clip.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
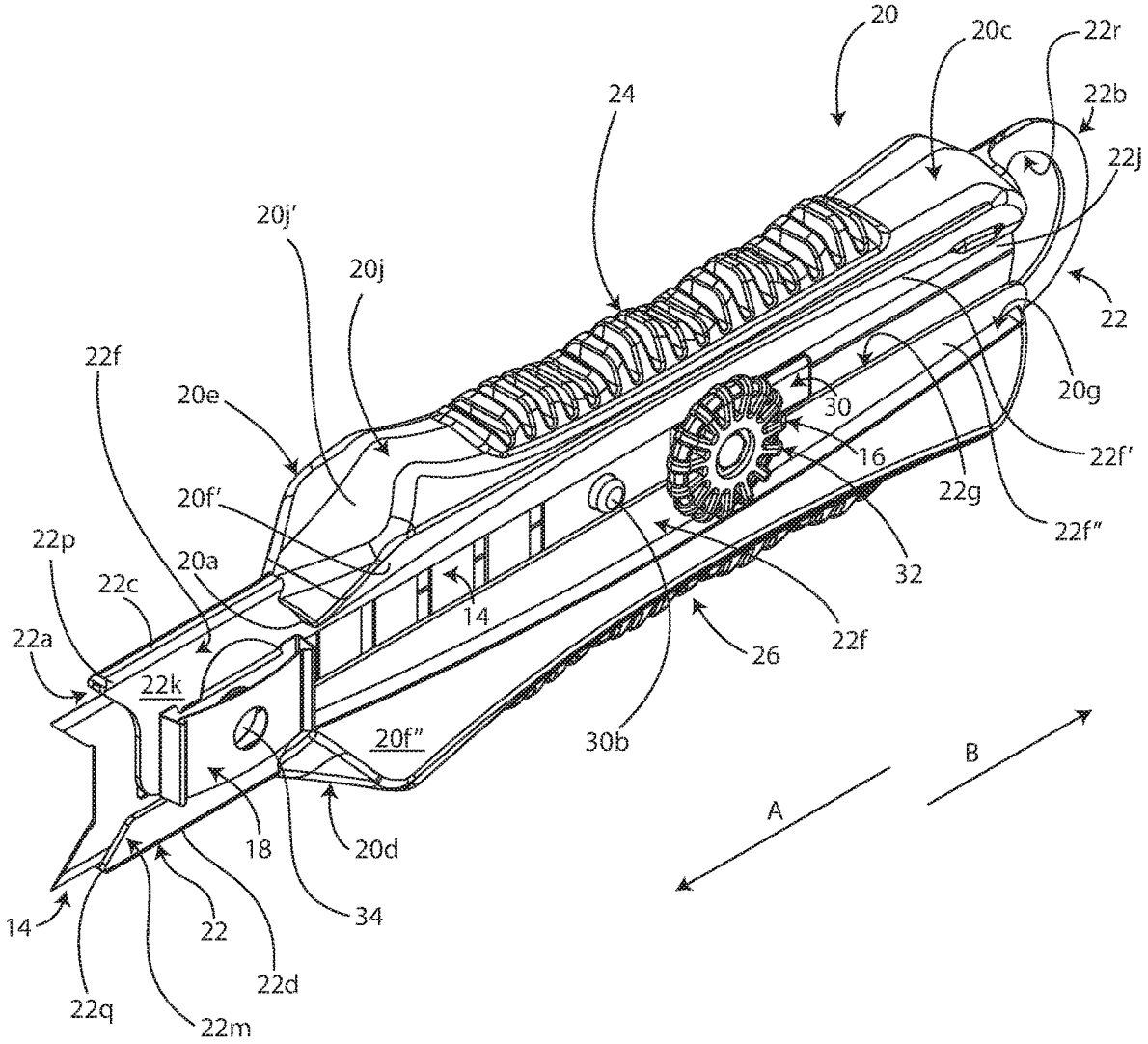
FIG. 1 is a top, front, left side, perspective view of a utility knife in accordance with an aspect of the present disclosure.

Referring to FIGS. 1-41, there is shown a utility knife in accordance with the present disclosure, generally indicated by the reference number 10. Knife 10 may be utilized for a wide variety of different uses, where those uses are similar to how previously-known utility knives have been used. In particular, knife 10 is contemplated as being advantageously suitable for cutting sheets of drywall. More specifically, knife 10 is contemplated as being particularly suitable for simultaneously measuring and cutting drywall sheets. The various component parts of knife 10 and the use of knife 10 will be described hereafter in greater detail.

Referring to FIGS. 1-12, knife 10 comprises a housing 12, a blade member 14, a locking mechanism 16, and a tape engagement clip 18. The blade member 14 that is shown in these figures is a first embodiment of a blade member that may be utilized with knife 10. Later in this disclosure, at least a second embodiment of a blade member will be described for use with knife 10. Similarly, the tape engagement clip 18 that is shown in FIGS. 1-12 is a first embodiment of a tape engagement clip that is able to form part of knife 10. Later in this disclosure, at least a second embodiment of a tape engagement clip will be described as being able to form a part of knife 10. Knife 10 has a first end 10*a* and a second end 10*b* and a longitudinal axis "Y" (FIGS. 4 and 8) extending between first end 10*a* and second end 10*b*. First end 10*a* comprises a front end of the knife 10, meaning that it is the end of the knife 10 from which a leading end of blade member 14 may be caused to extend in order to perform a cutting operation. Second end 10*b* comprises a rear end of the knife 10.

In accordance with an aspect of the present disclosure, housing 12 comprises a first housing section 20 and a second housing section 22. First and second housing sections 20, 22 are complementary with each other and are configured to be interlockingly engaged together. When interlockingly engaged, first and second housing sections 20, 22 together form an ergonomic shape that makes housing easy and comfortable for a person to hold and manipulate.

First and second housing sections 20, 22 are fabricated from any suitable material in any suitable manner. For example, one or both of first and second housing sections 20, 22 may be molded from plastic or die-cast from metal or may be partially fabricated from metal and partially fabricated from plastic. It will be understood, however, that any suitable materials may be selected to fabricate housing 12.

Figure 8:
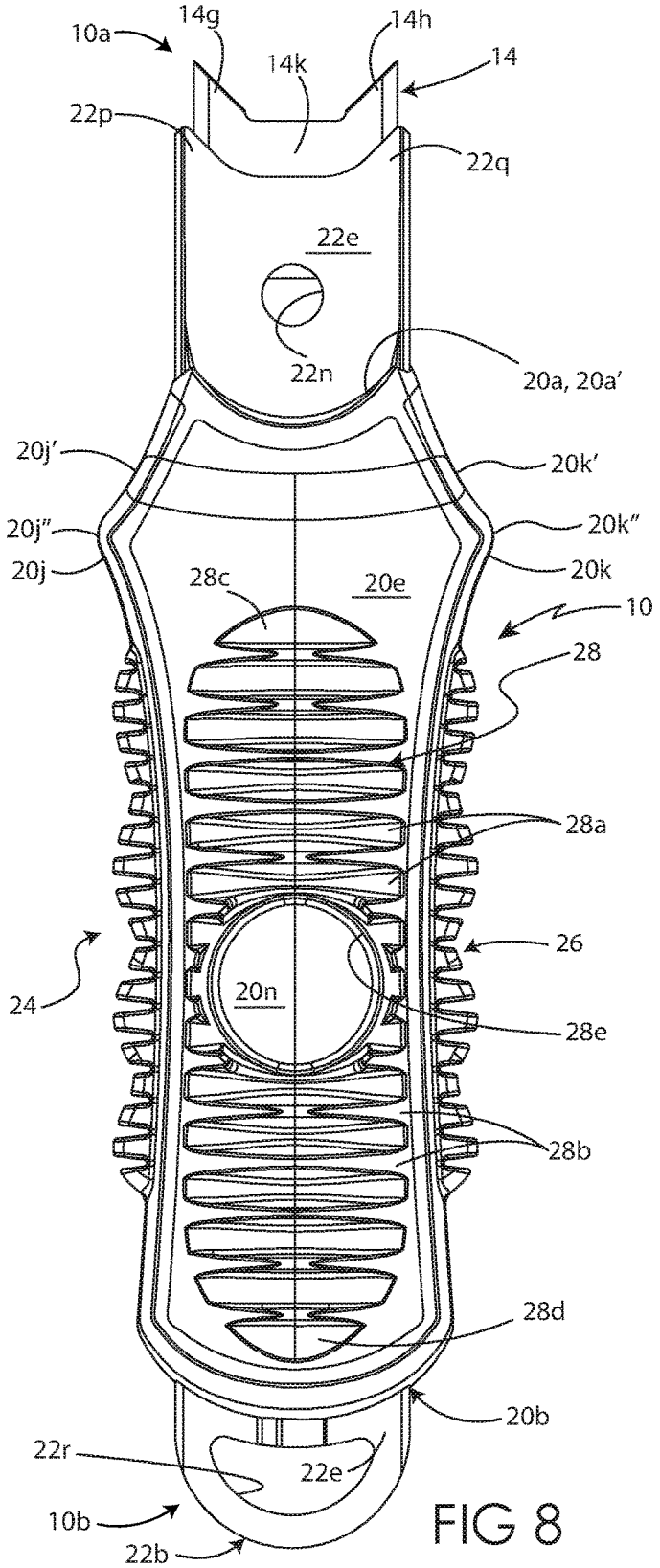
FIG. 8 is a right side elevation view of the utility knife

First housing section 20 is an integrally-formed component which has a first end 20*a*, a second end 20*b*, a first wall 20*c*, a second wall 20*d*, a first side wall 20*e*, and a pair of laterally spaced-apart second side wall sections 20*f*' and 20*f*". First end 20*a* and second end 20*b* are opposed to each other and define a longitudinal direction therebetween. First wall 20*c* and second wall 20*d* are opposed to each other and define a vertical direction therebetween. First side wall 20*e* and second side wall sections 20*f*' and 20*f*" are opposed to each other and define a lateral or transverse direction therebetween. First side wall 20*e* has a midline "M" (FIG. 8) which extends from first end 20*a* to second end 20*b* and is generally parallel to longitudinal axis "Y". Second housing 20 is substantially symmetrical about midline "M" as is best seen in FIG. 8.

Figure 4:
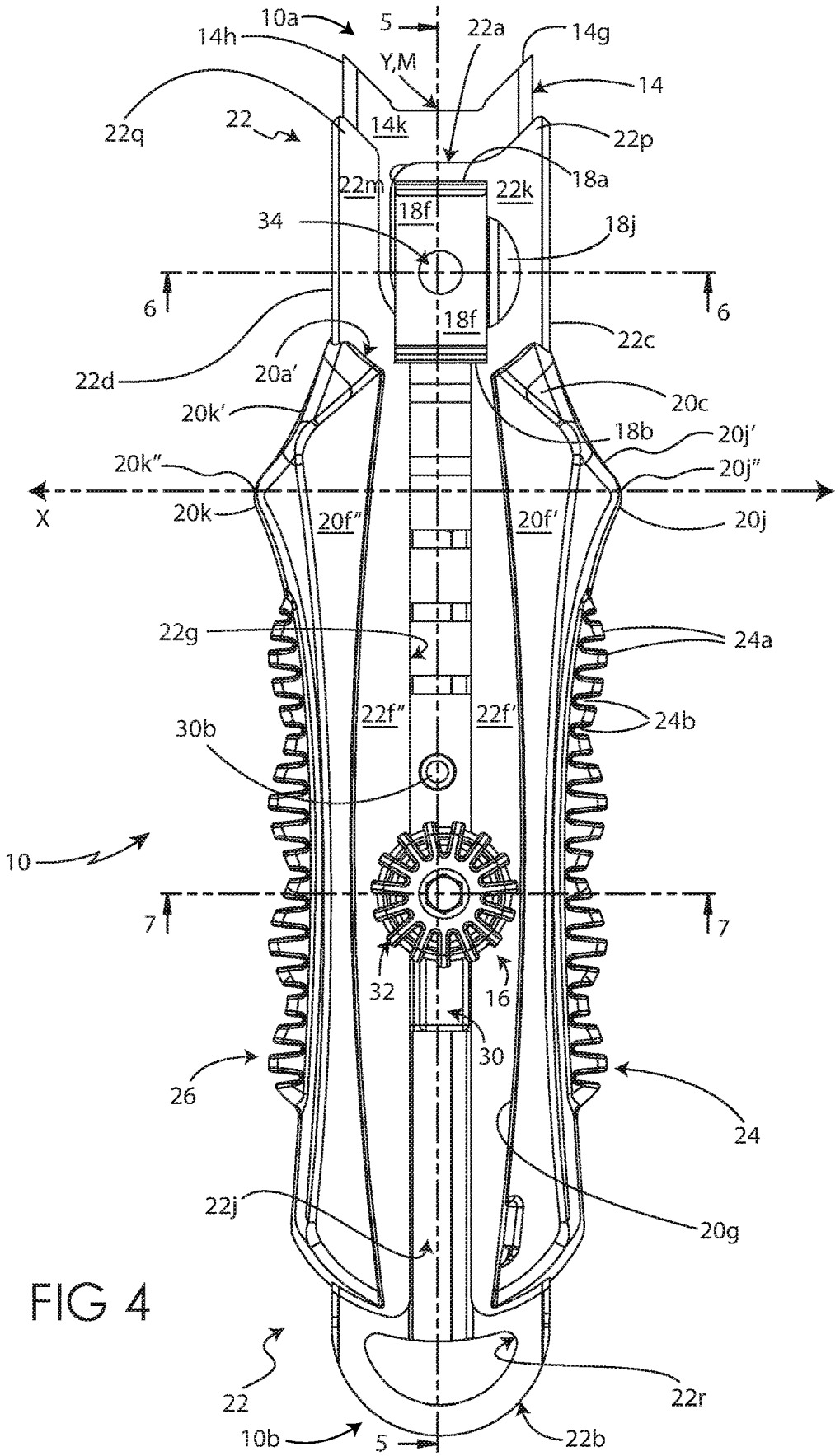
FIG. 4 is left side elevation view of the knife.
Figure 9:
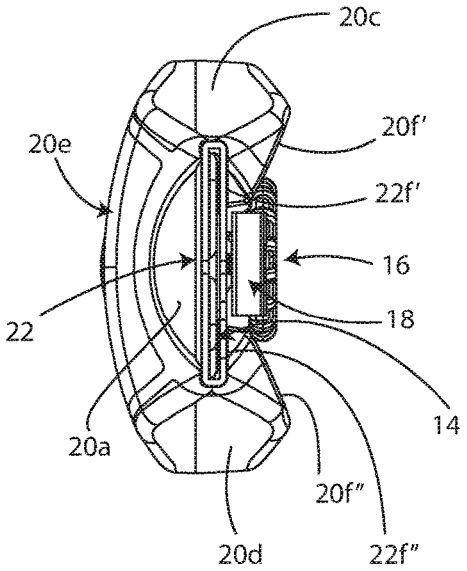
FIG. 9 is a front elevation view of the utility knife shown in FIG. 8.

A longitudinally-extending slot 20*g* is defined between second side wall sections 20*f*' and 20*f*". Slot 20*g* extends from first end 20*a* to second end 20*b* and divides second side wall sections 20*f*' and 20*f*". Slot 20*g* extends substantially parallel to midline "M". A first of the second wall sections identified by the reference number 20*f*' is integral with first wall 20*c* and a second of the second wall sections identified by the reference number 20*f*" is integral with second wall 20*d*. As best seen in FIG. 4 and FIG. 9 second wall sections 20*f*' and 20*f*" angle outwardly away from slot 20*g* and away from each other. As will be described later herein, the angling second wall sections 20*f*' and 20*f*" create a depression along one side of knife 10. Portions of locking mechanism 16 extend into this depression.

First housing section 20, when viewed from either of first end 20*a* or second end 20*b*, is generally C-shaped in cross-section. Together, first wall 20*c*, first side wall 20*e*, second wall 20*d*, and second side wall sections 20*f*' and 20*f*" bound and define an interior cavity 20*h*. An opening 20*a*' (FIG. 3A) defined by first end 20*a*, an opening 20*b*' (FIG. 3*b*) defined by second end 20*b*, and slot 20*g* provide access into interior cavity 20*h*.

In accordance with an aspect of the present disclosure, first wall 20*c* and second wall 20*d* are substantially identical in configuration and are arranged on first housing section 20 as mirror images of each other. Each of first wall 20*c* and second wall 20*d* is formed to include a V-shaped region that is located a distance rearwardly from first end 20*a*. The V-shaped region on first wall 20*c* is identified by the reference number 20*j* (FIGS. 1 and 3A) and the V-shaped region on second wall 20*d* is identified by the reference number 20*k* (FIGS. 2 and 3B). The V-shaped region 20*j* on first wall 20*c* is an inverted V-shape relative to the V-shaped region 20*k* on second wall 20*d*. The two V-shaped regions 20*j*, 20*k* are transversely aligned with each other, with the apex 20*j*" and 20*k*", respectively, of each V-shape being aligned along a transverse axis "X" (FIG. 4) that is oriented at 90 degrees relative to longitudinal axis "Y".

FIG. 4 shows that first wall 20*c* is curved from V-shaped region 20*j* through to proximate second end 20*b* of first housing section 20. In particular, first wall 20*c* is concavely shaped from V-shaped region 20*j* to proximate second end 20*b*. Similarly, second wall 20*d* is curved from V-shaped region 20*k* through to proximate second end 20*b* of first housing section 20. In particular, second wall 20*d* is concavely shaped from V-shaped region 20*k* to proximate second end 20*b*.

Figure 3A:
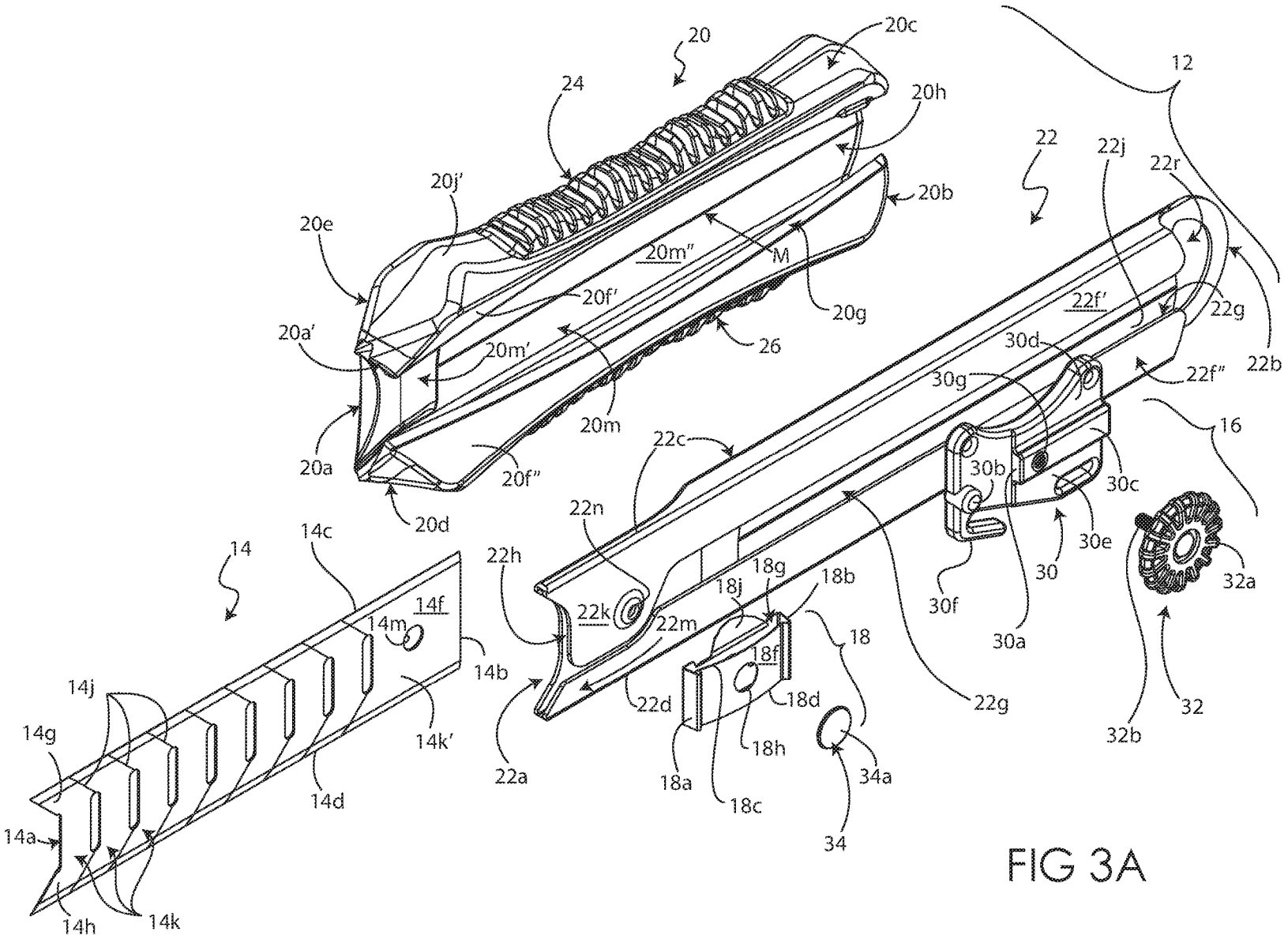
FIG. 3A is an exploded top, front, left side, perspective view of the utility knife of FIGS. 1 and 2.
Figure 3B:
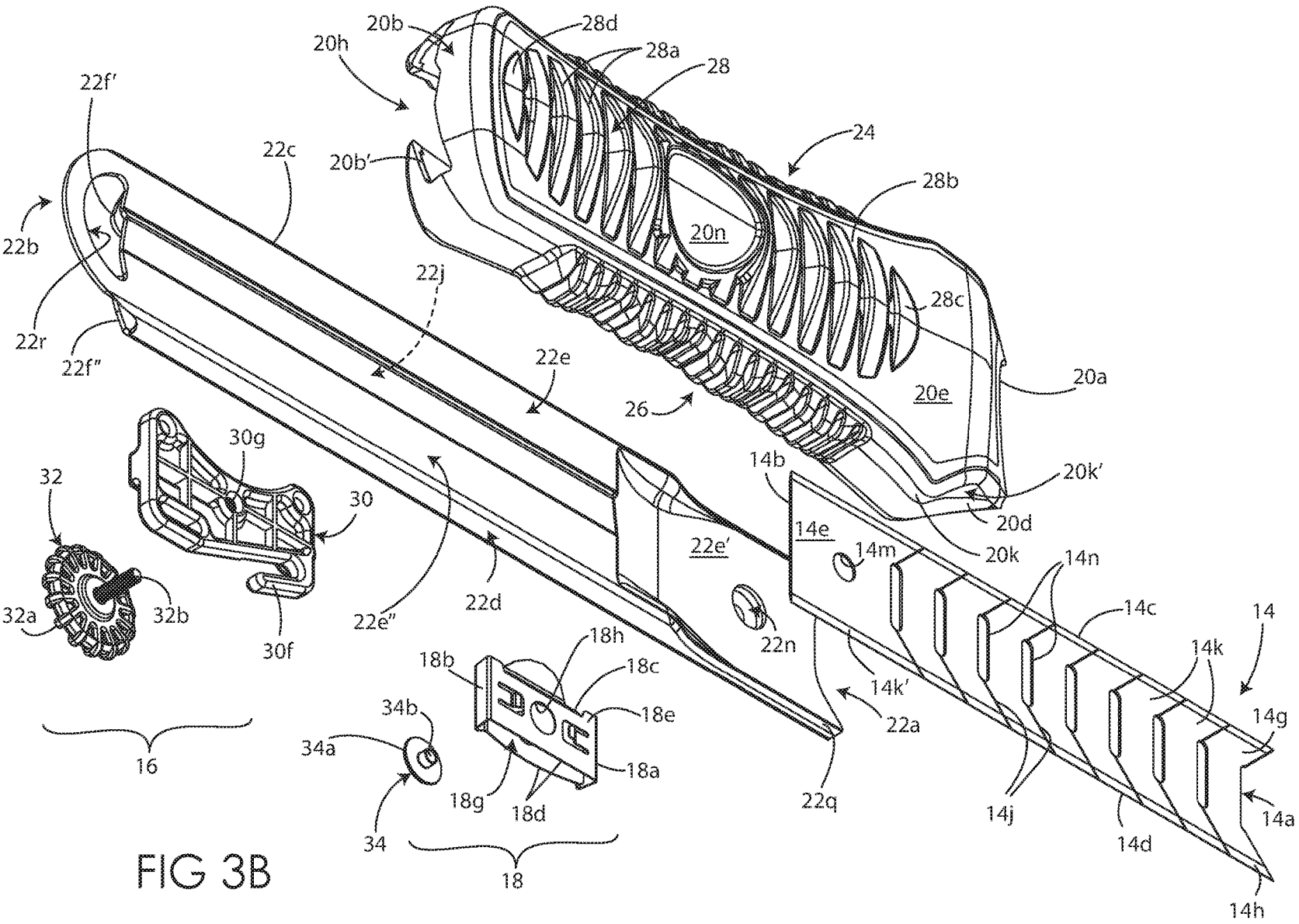
FIG. 3B is an exploded bottom, back, right side, perspective view of the utility knife of FIGS. 1 and 2.
Figure 5:
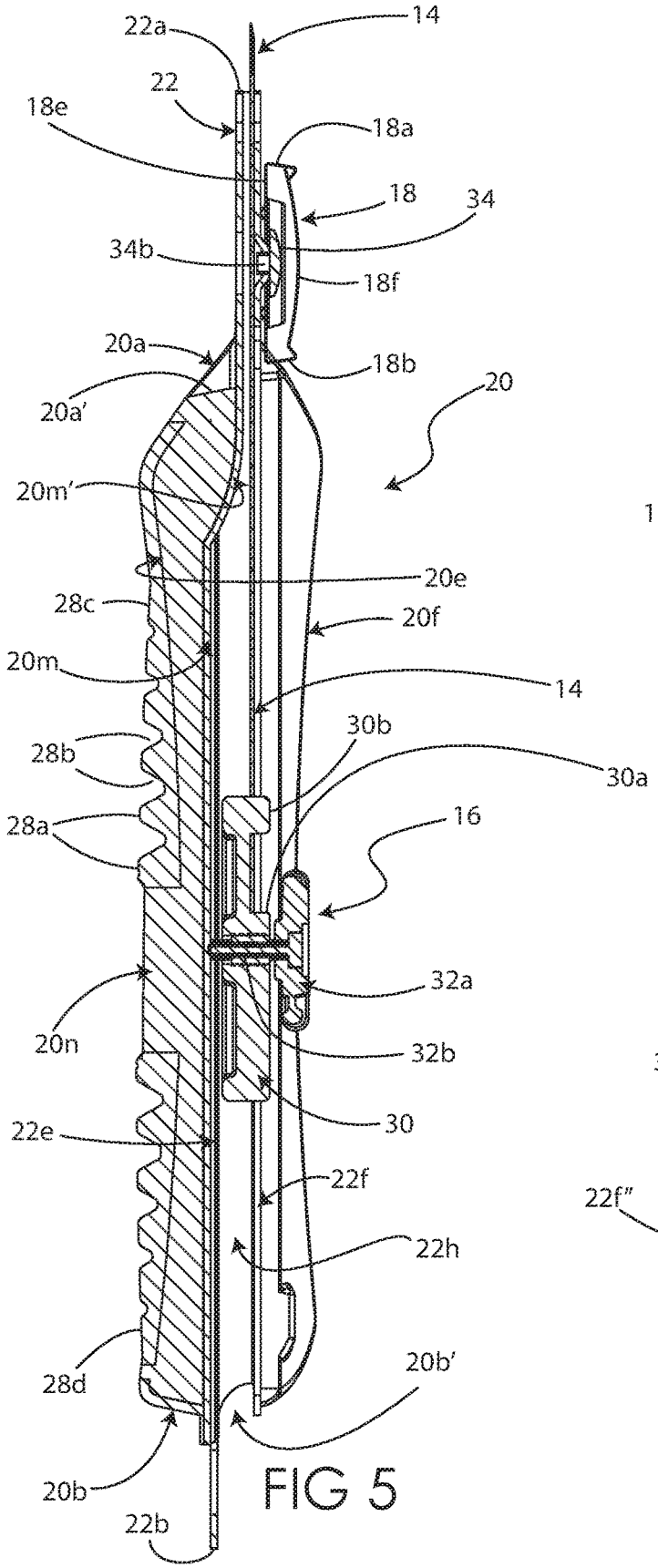
FIG. 5 is a longitudinal cross-section of the utility knife taken along line 5-5 of FIG. 4.
Figure 6:
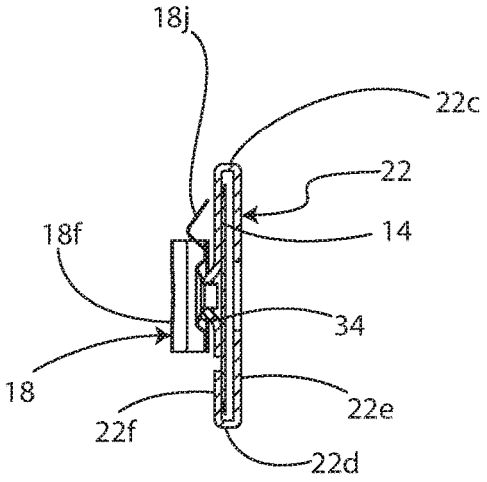
FIG. 6 is a transverse cross-section of the utility knife taken along line 6-6 of FIG. 4.
Figure 7:
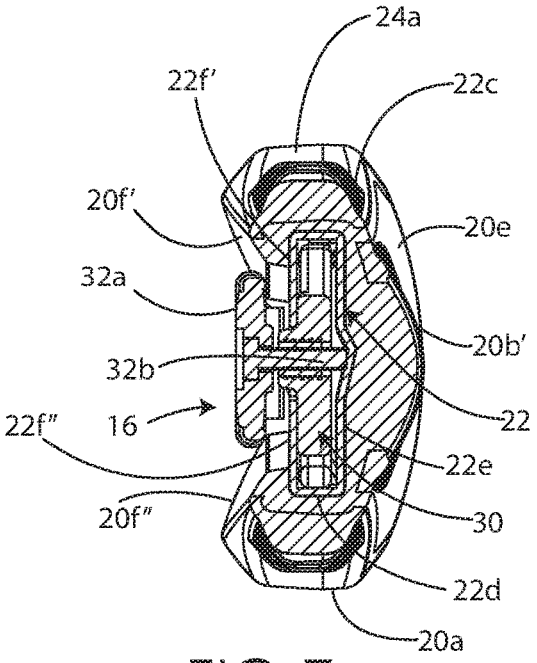
FIG. 7 is a transverse cross-section of the utility knife taken along line 7-7 of FIG. 4.

Referring to FIGS. 3A and 5, first side wall 20*e* of first housing section 20 has an interior surface 20*m* that bounds and defines part of interior cavity 20*h*. Interior surface 20*m* extends from first end 20*a* to second end 20*b* and includes a first section 20*m*' and a second section 20*m*". First section 20*m*' originates proximate first end 20*a* and extends rearwardly for a distance toward second end 20*b*. First section 20*m*' is curved, particularly generally convexly curved. Second section 20*m*" is flat from first section 20*m*' up to second end 20*b*. First section 20*m*' projects inwardly into interior cavity 20*h* and towards second wall 20*d* and because of this, the width of the interior cavity 20*h* proximate first section 20*m*' gradually narrows. The width is the distance between the interior surface of first side wall 20*e* and the interior surface of second side wall sections 20*f*' and 20*f*". The width of interior cavity 20*h* as defined between second section 20*m*" and innermost regions of second side wall sections 20*f*' and 20*f*" is substantially constant.

In accordance with another aspect of the present disclosure, a first overmold 24 is provided on first wall 20*c* and a second overmold 26 is provided on second wall 20*d*. First overmold 24 and second overmold 26 extend from a location rearward of the respective V-shaped region 20*j*, 20*k* to a location forward of second end 20*b*. First and second overmolds 24, 26 preferably are soft, resilient rubber overmolds but it will be understood that any other suitable material may be utilized for first and second overmolds 24, 26.

First and second overmolds 24, 26 are substantially identical in structure and function but are arranged on first housing section 20 as mirror images of each other. First overmold 24 includes a plurality of ribs 24*a* that are arranged so that a space 24*b* is defined between adjacent ribs 24*a*. The ribs 24*a* are of varying heights (where the height is the distance from curved first wall 20*c* to a free end of the rib). The ribs 24*a* are grouped by height to form alternating peaks and valleys giving the first overmold 24 the appearance of a sine wave when the front or back of the first housing section 20 is viewed (FIG. 4 or FIG. 8). Similarly, second overmold 26 includes a plurality of ribs 26*a* that are arranged so that a space 26*b* is defined between adjacent ribs 26*a*. The ribs 26*a* are of varying heights and are grouped by height to form alternating peaks and valleys, giving the second overmold 26 the appearance of a sine wave when the front or back of the first housing section 20 is viewed (FIG. 4 or FIG. 8). The undulating hills and valleys provide an ergonomically-shaped gripping region on first housing section 20 which aids in easing hand and wrist fatigue when the user is performing repetitive cutting motions.

Figure 2:
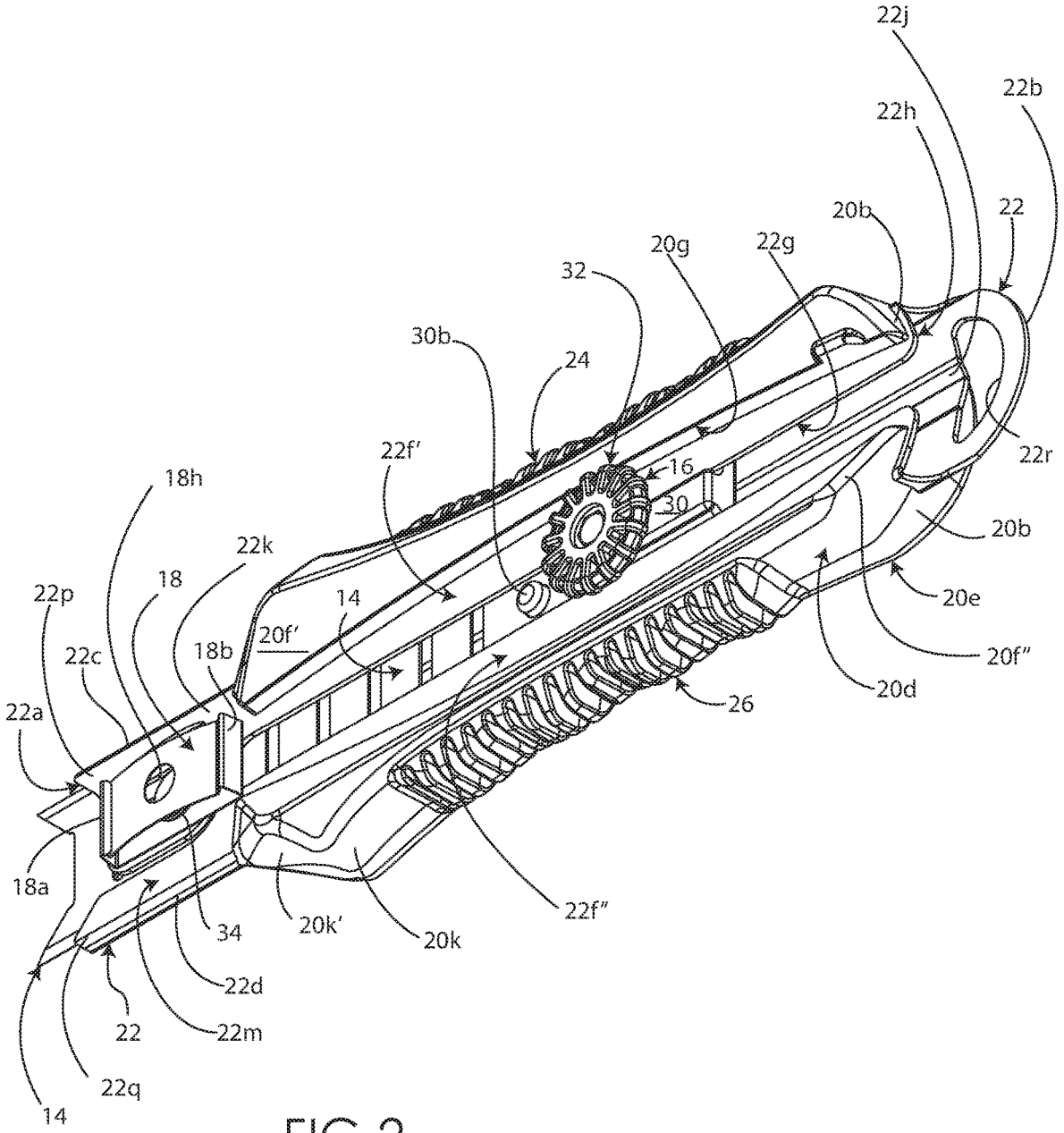
FIG. 2 is a bottom, front, left side, perspective view of the utility knife of FIG. 1.

As best seen in FIG. 1, portions of the first side wall 20*e* and second side wall sections 20*f*' and 20*f*" extend outwardly for a distance beyond the regions of first wall 20*c* that do not include first overmold 24. Similarly, as best seen in FIG. 2, portions of the second side wall sections 20*f*' and 20*f*" extend outwardly for a distance beyond regions of the second wall 20*d* that do not include second overmold 26.

Referring now to FIGS. 3B, 5, and 8, a third overmold 28 is provided on the exterior surface of first side wall 20*e*. Third overmold 28 is comprised of the soft, resilient rubber or any other suitable material used for first and second overmolds 24, 26. The overmolds 24, 26, 28 are durable and provided a non-slip, cushion grip that is able to be used by both left-handed and right-handed users in two different orientations. Third overmold 28 includes a plurality of upstanding ribs 28*a* that are spaced longitudinally from each other, with adjacent ribs 28*a* being separated from each other by a space 28*b*. Ribs 28*a* are oriented generally parallel to each other and at right angles to longitudinal axis "Y". Substantially all of the ribs 28*a* are of the same height, with the height being measured from the exterior surface of first wall 20*e* to an outermost edge of the rib 28*a*. The majority of ribs 28*a* are of substantially the same width, measured in the transverse direction between first wall 20*c*, and second wall 20*d*, except for the ribs described hereafter. The majority of the ribs 28*a* have substantially vertical, slightly curved walls that bound and define part of the adjacent space 28*b*. At least a forwardmost and a rearmost of the ribs, indicated by the reference numbers 28*c*, 28*d*, respectively, are shorter in width and have one side that is straight and the opposing side is curved.

In addition to the differently shaped end ribs 28*c*, 28*d*, a rim 28*e* bounds and defines an aperture (FIGS. 3B, 5 and 8) in a region of overmold 28 that is generally centrally located along the length of first side wall 20*e*. The rim 28*e* and associated aperture are illustrated as being generally circular in shape. It will be understood, however, that the rim and aperture could be square or rectangular, or an irregular shape, if that is so desired. A projection 20*n* of first side wall 20*e* extends through the aperture bounded and defined by rim 28*e*. The projection 20*n* is complementary to the aperture defined by rim 28*e*. The projection 20*n* is illustrated as having a flattened outermost surface that is substantially flush with the height of the ribs 28*a* on third overmold 28. The projection 20*n* may, alternatively, be concavely or convexly curved but this is not shown in the attached figures. The purpose of projection 20*n* will be described later herein. Portions of ribs 28*a* extend outwardly from rim 28*e* towards first wall 20*c* and towards second wall 20*d*. These portions of ribs 28*a* are obviously not of the same width as the rest of the ribs 28*a* that flank rim 28*e*.

Turning now to FIGS. 3A, 3B, and 5, second housing section 22 is described in greater detail. Second housing section 22 has a first end 22*a* and a second end 22*b* defining a longitudinal direction between them. Second housing section 22 also includes a first wall 22*c*, a second wall 22*d*, a first side wall 22*e*, and a second side wall 22*f*. The exterior shape of second housing section 22 is such that a least a portion thereof is complementary to the interior shape of first housing section 20. (The interior shape of the first housing section 20 comprises the various surfaces that bound and define interior cavity 20*h*.) In particular, first side wall 22*e* is complementary in shape to the interior surface 20*m* of first side wall 2. As such, the outer surface of first side wall 22*e* includes a first section 22*e*' that is complementary in curvature to the curvature of curved first section 20*m*' of first side wall 20*e* of first housing section 20. The outer surface of first side wall 22*e* also includes a flat second section 22*e*" that is complementary to the flat second section 20*m*" of first housing section 20.

Figure 10:
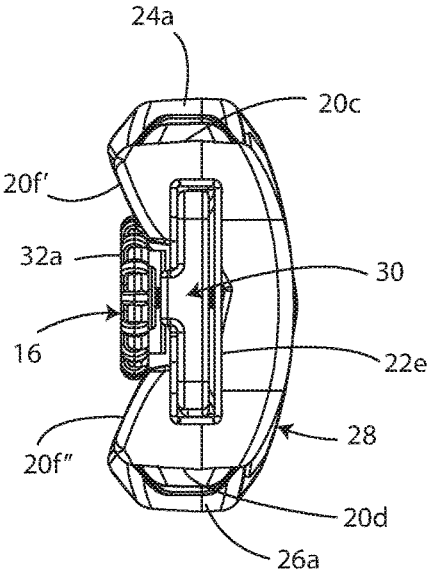
FIG. 10 is a rear elevation view of the utility knife shown in FIG. 8.

Second side wall 22*f* is comprised of a first section 22*f*' and a second section 22*f*". An elongated slot 22*g* is defined between an edge of first section 22*f*' and an edge of second section 22*f*". First section 22*f*', first wall 22*c*, first side wall 22*e*, second wall 22*d*, and second section 22*f*" bound and define an interior chamber 22*h* (FIGS. 3A, 5, and 10). A groove 22*j* is defined on an inner surface of first side wall 22*e*. Groove 22*j* extends longitudinally along the inner surface of first side wall 22*e* and is substantially aligned with slot 22*g*.

In accordance with the present disclosure, a first end 22*k* (FIG. 3A) of first section 22*f*' of second side wall 22*f* is of a greater height that the rest of the first section 22*f*', i.e., the distance between first wall 22*c* and the edge of first end 22*k* is greater than the distance between first wall 22*c* and the edge that defines slot 22*g*. (It can be seen that slot 22*g* effectively terminates in a rear edge of first end 22*k*.). A front end 22*m* of second section 22*f*" of second side wall 22*f* is of a smaller height than the rest of second section 22*f*". In other words, the distance from second wall 22*d* to an edge of front end 22*m* is shorter than the distance from second wall 22*d* to the edge of second section 22*f*" that defines slot 22*g*. The edge of first end 22*k* and edge of front end 22*m* are both curved in a complementary manner so that the two edges are in close proximity. Aligned apertures 22*n* (FIGS. 3A and 3B).

As best seen in FIGS. 3A, 3B and 4, first end 22*a* of second housing section 22 is generally U-shaped. In particular, the leading end of first side wall 22*e* is generally U-shaped and together, the leading ends of first end 22*k* and front end 22*m* together form a generally U-shaped edge. The U-shaped edge forms two tips 22*p* and 22*q*, the purpose of which will be described later herein.

In accordance with another feature of the present disclosure, first side wall 22*e* is longer than second side wall 22*f*. This can be seen in FIG. 3A. The rear edge of first side wall 22*e* forms the second end 22*b* of second housing section 22. This rear edge is convexly shaped, in particular, semi-circular. A hole 22*r* is defined in first side wall 22*e* a short distance forwardly from the rear edge. Hole 22*r* extends between the inner surface of first side wall 22*e* and the outer surface thereof. Hole 22*r* is illustrated herein as being generally semi-circular but any other shaped hole 22*r* may be formed therein. Hole 22*r* may be utilized to hang knife 10 on a peg board in a workshop, or may receive a clip to secure knife 10 to a tool belt etc.

Second housing section 22 is engaged with first housing section 20 by inserting second end 22*b* through opening 20*a*' in first end 20*a* of first housing section 20 and into interior chamber 20*h*. Second housing section 22 is moved rearwardly until second end 22*b* thereof extends outwardly through opening 20*b*' in second end 20*b* of first housing section 20. Rear movement of second housing section 22 is arrested when the curved first section 22*e*' of first side wall 22*e* is complementarily nested with curved first section 20*m*' of first side wall 20*e* of first housing section 22. Second housing section 22 may be retained in engagement with first housing section 20 by friction. Alternatively an adhesive may be applied to a portion of the exterior surface of second housing section 22 that will be proximate the interior surface of first housing section. The adhesive may be applied prior to inserting the second housing section 22 into the interior chamber 20*h* of first housing section 20. When second housing section 22 is engaged with first housing section 20, a first part of the second housing section 22 extends forwardly beyond first end 20*a* of first housing section 20; and a second part of second housing section 22 extends rearwardly beyond second end 20*b* of first housing section 20.

FIGS. 3A, 3B, 13A, and 13B show the first embodiment blade member 14 in greater detail. Blade member 14 comprises a planar sheet of metal which has a first end 14*a*, a second end 14*b*, a first edge 14*c*, a second edge 14*d*, a first side 14*e* (FIG. 3A), and a second side 14*f*. Blade member 14 has a midline that is substantially equidistant from the first edge and the second edge (and will be parallel to longitudinal axis "Y" and midline "M" of housing 12); and the blade member 14 is symmetrical about the blade member's midline. First end 14*a* is generally U-shaped and is configured such that two inverted V-shaped tips 14*g*, 14*h* are formed where first end 14*a* intersects first edge 14*c* and second edge 14*d*, respectively. Tips 14*g* and 14*h* extend outwardly from blade member in the same direction. Previously-known blade members used in previously-known utility knives have a single inverted V-shaped tip or have had two V-shaped tips but those two tips have been laterally aligned with each other and extending outwardly from a central region in opposite directions. Additionally, a single cutting edge has extended between these V-shaped tips in previously-known blade members. In order to use previously-known two-tipped blade members, a user had to open up the housing of the previously-known knives and had to rotate the blade through 180°. As will be described later herein, there is no need to open the housing 12 of the present knife 10 in order to present a fresh cutting surface.

Additionally, unlike previously-known blade members used with previously-known utility knives, both first edge 14*c* and the second edge 14*d* of blade member 14 are sharpened to form cutting surfaces. In previously-known blade members, only the bottom edge is sharpened into a cutting surface. This is the case even if the previously-known blade has had two tips extending in opposite directions from each other; the same single cutting surface is provided on that blade. Because of this arrangement, it is has been necessary for a user to open up the previously-known knife housing, rotate the previously-known blade through 180°, and then close the housing once again. In the presently disclosed knife 10, all that is required to provide a fresh cutting surface is to rotate the housing 12 through 180°.

Furthermore, because of the presence of two cutting surfaces 14*c*, 14*d* and two tips 14*g*, 14*h*, blade member 14, and thereby knife 10, is capable of being used in two different orientations that are 180 degrees apart. Previously-known utility knives have only been able to be used in a single orientation and that is with the single sharpened cutting surface (i.e., the sharped bottom edge) of the previously-known blade members positioned to contact a surface to be cut. With the presently-disclosed knife 10, either of the sharpened cutting surfaces of the first edge 14*c* and the second edge 14*d* may be brought into contact with a surface to be cut.

A plurality of lines of weakness 14*j* are defined at spaced intervals along the length of blade member 14. Each line of weakness 14*j* is substantially identical in configuration to front end 14*a*. In other words, each line of weakness 14*j* is substantially U-shaped. The lines of weakness separate blade segments from each other. FIGS. 3A and 3B show blade member 14 having eight lines of weakness 14*j* and thereby dividing blade member 14 into nine blade segments 14*k*. All of the blade segments 14*k* are identical except for the rearmost blade segment which is identified by the reference number 14*k*'. Blade segment 14*k*' is larger than the other blade segments 14*k* and includes second end 14*b*. A hole 14*m* is defined in blade segment 14*k*'. Hole 14*m* extend from first side 14*e* through to second side 14*f*. A plurality of apertures 14*n* are defined in blade member 14 extending from first side 14*e* through to second side 14*f*. Each aperture 14*n* is positioned along one of the lines of weakness 14*j*.

Blade member 14 is received within interior chamber 22*h* of second housing section 22 in an orientation that places rearmost blade segment 14*k*' closest to second end 20*b* of first housing section 20 and places a leading blade segment 14*k* (i.e., the one that includes first end 14*a*) closes to first end 20*a* of first housing section 20.

Blade member 14 is secured to second housing section 22 by locking mechanism 16. Locking mechanism 16 comprises a carriage 30 and a locking knob 32. FIG. 5, in particular, shows the engagement of blade member 14 with carriage 30 and locking knob 32. Carriage 30 is configured to be received within the interior chamber 22*h* of second housing section 22. Second end 14*b* of blade member 14 abuts a shoulder 30*a* (FIG. 3A) of carriage 30 and a pin 30*b* of carriage 30 extends through hole 14*m* defined in rearmost segment 14*k*'. A boss 30*c* of carriage 30 is configured and sized to be received through slot 22*g* defined between second side wall sections 20*f*', 20*f*" of second housing section 22. Flanges 30*d*, 30*e* abut the interior surfaces of second side wall sections 20*f*', 20*f*" and ride therealong as blade member 14 is extended or retracted relative to first end 22*a* of second housing section (as will be described later herein). An arm 30*f* extends outwardly from carriage 30 to ride along the surface of second wall 22*d* of second housing section 22. A threaded aperture 30*g* is defined in carriage 30 and this aperture 30*g* extends from a first side of carriage to a second side thereof.

Locking knob 32 includes a head 32*a* and a threaded shaft 32*b*. Shaft 32*b* passes through aperture 30*g* in carriage 30 and the threads on shaft 32*b* threadably engage the threads bounding aperture 30*g*. A free end of shaft 32*b* is received within groove 22*j* defined in first side wall 22*e* of second housing section 22. When locking knob 32 is rotated in a first direction, the free end of shaft 32*b* does not contact the inner surface of first end wall 22*e* and carriage 30 is therefore able to be moved longitudinally within interior chamber 22*h* in one of a first direction "A" (FIG. 1) or a second direction "B". When locking knob 32 is rotated in a second direction, the free end of shaft 32*b* contacts the inner surface of first end wall 22*e*, and carriage 30 cannot be moved in either of the first direction "A" or the second direction "B". Consequently, when a person wishes to extend blade member 14 in such a way that the first segment 14*k* is located beyond first end 22*a* of second housing member 22, the locking knob 32 is rotated in the first direction and the person is able to slide blade member in the first direction "A" by grasping locking knob 32 and moving it toward first end 22*a*. When a desired sufficient length of blade member 14 extends beyond first end 22*a*, the locking knob 32 is rotated in the second direction to lock carriage 30 and thereby blade member 14 against further longitudinal movement. As is illustrated in FIG. 4, when the first blade segment 14*k* extends outwardly beyond first end 22*a*, the tips 22*p*, 22*q* of second housing member 22 extend for a distance along first and second sides 14*e*, 14*f*, and along portions of the cutting surfaces 14*c*, 14*d* of blade member 14 and protect the same. Knife 10 may be held in a person's left hand or right hand in one of two different orientations to contact a surface to be cut with either of the two cutting surfaces 14*c*, 14*d*.

As indicated earlier herein, knife 10 also includes a tape engagement clip 18. Tape engagement clip 18 is provided to enable a person to lock a free end of a measuring tape therein, as will be described later herein. Tape engagement clip 18 shown in FIGS. 1-12 is a first embodiment tape engagement clip that may be selectively engaged with knife 10.

Figure 11:
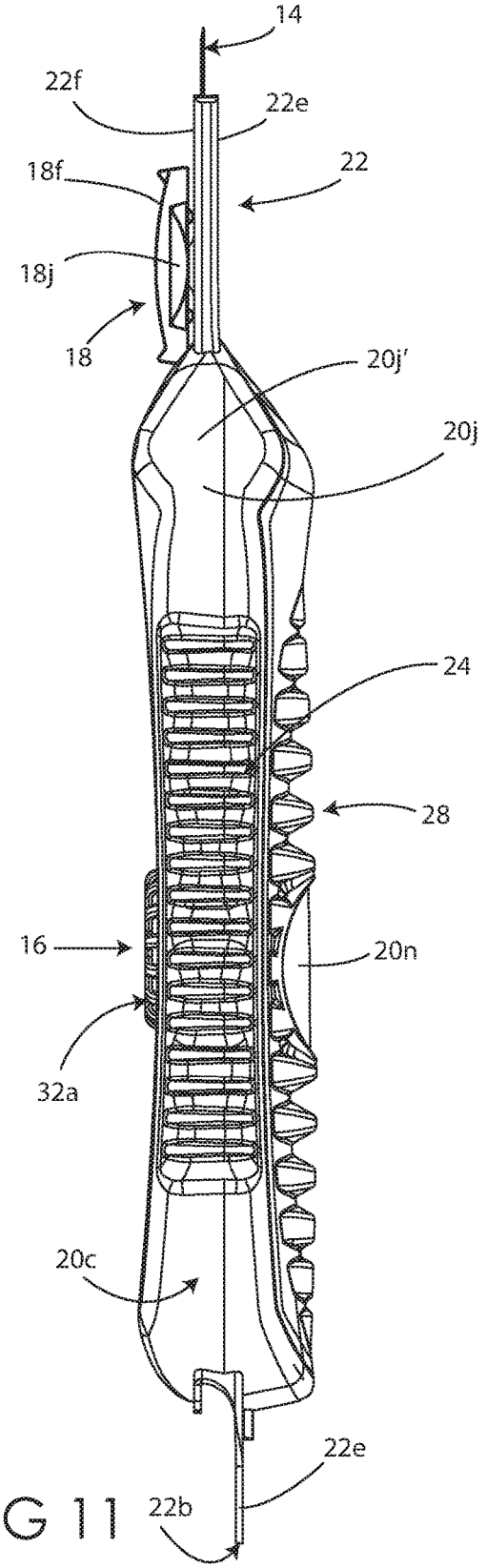
FIG. 11 is a top plan view of the utility knife.
Figure 12:
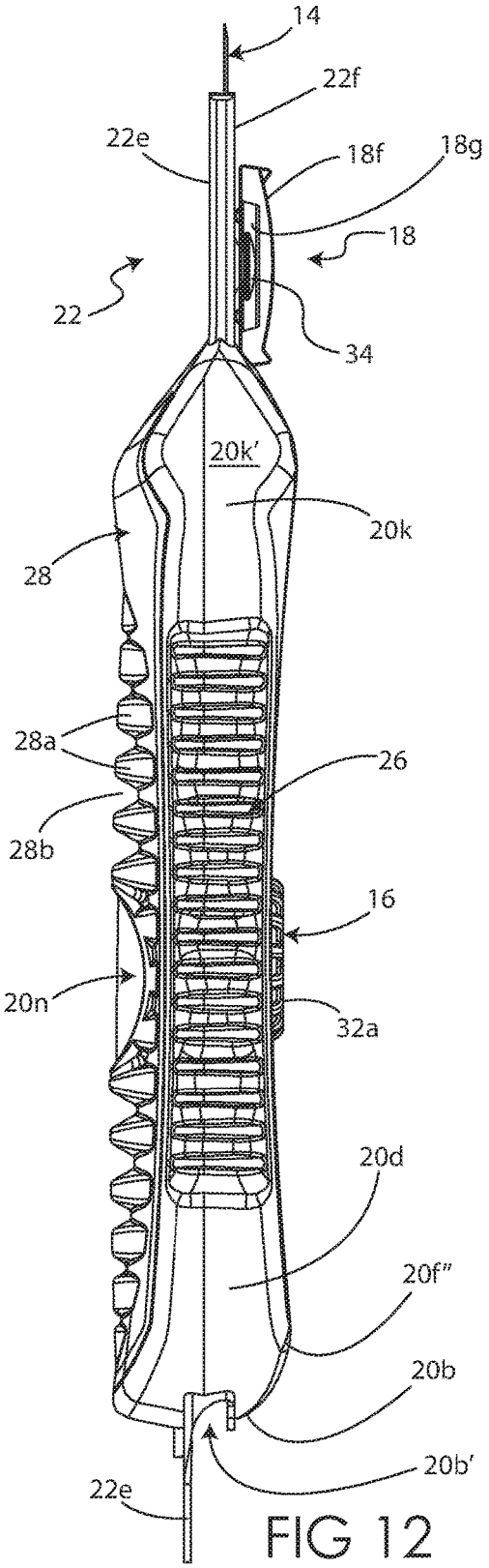
FIG. 12 is a bottom plan view of the utility knife.
Figure 13:
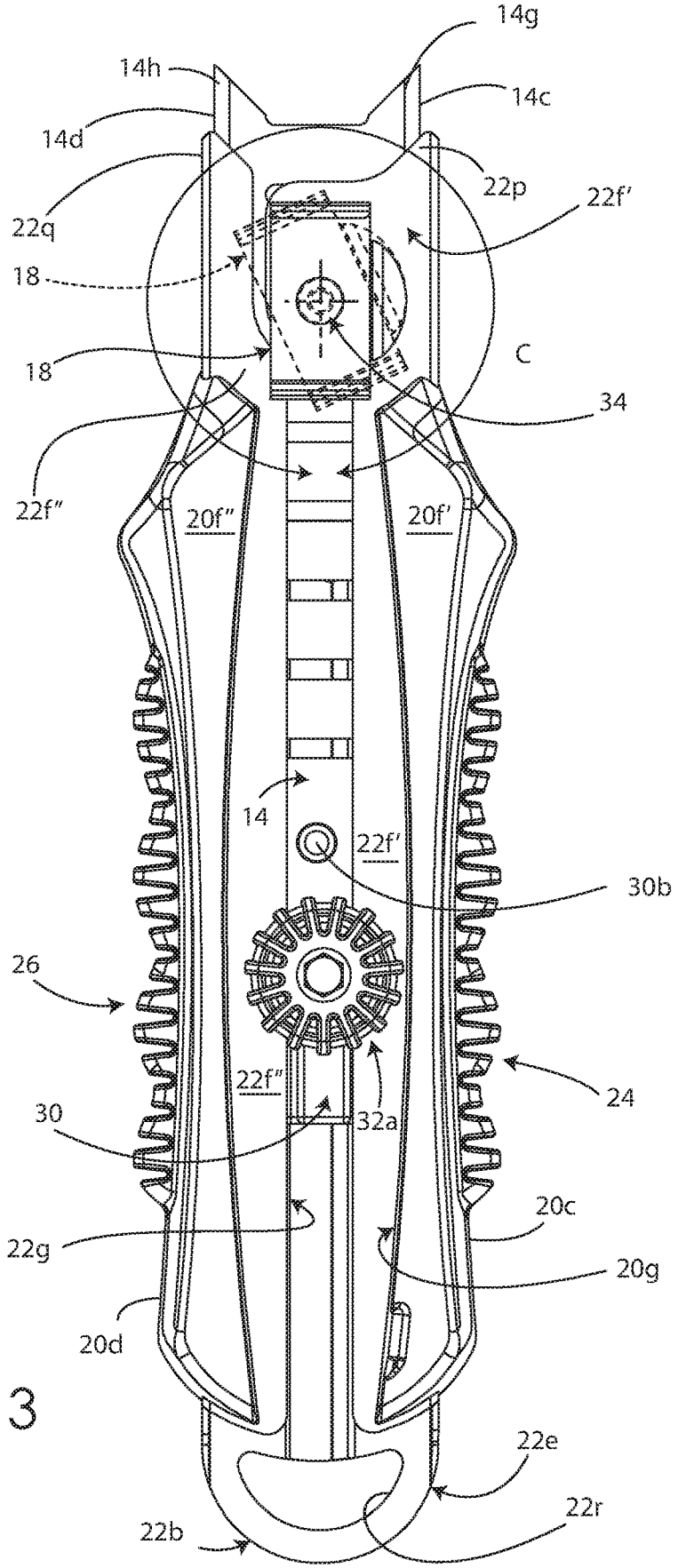
FIG. 13 is a left side elevation view of the utility knife showing the rotatability of the tape engagement clip.
Figure 36:
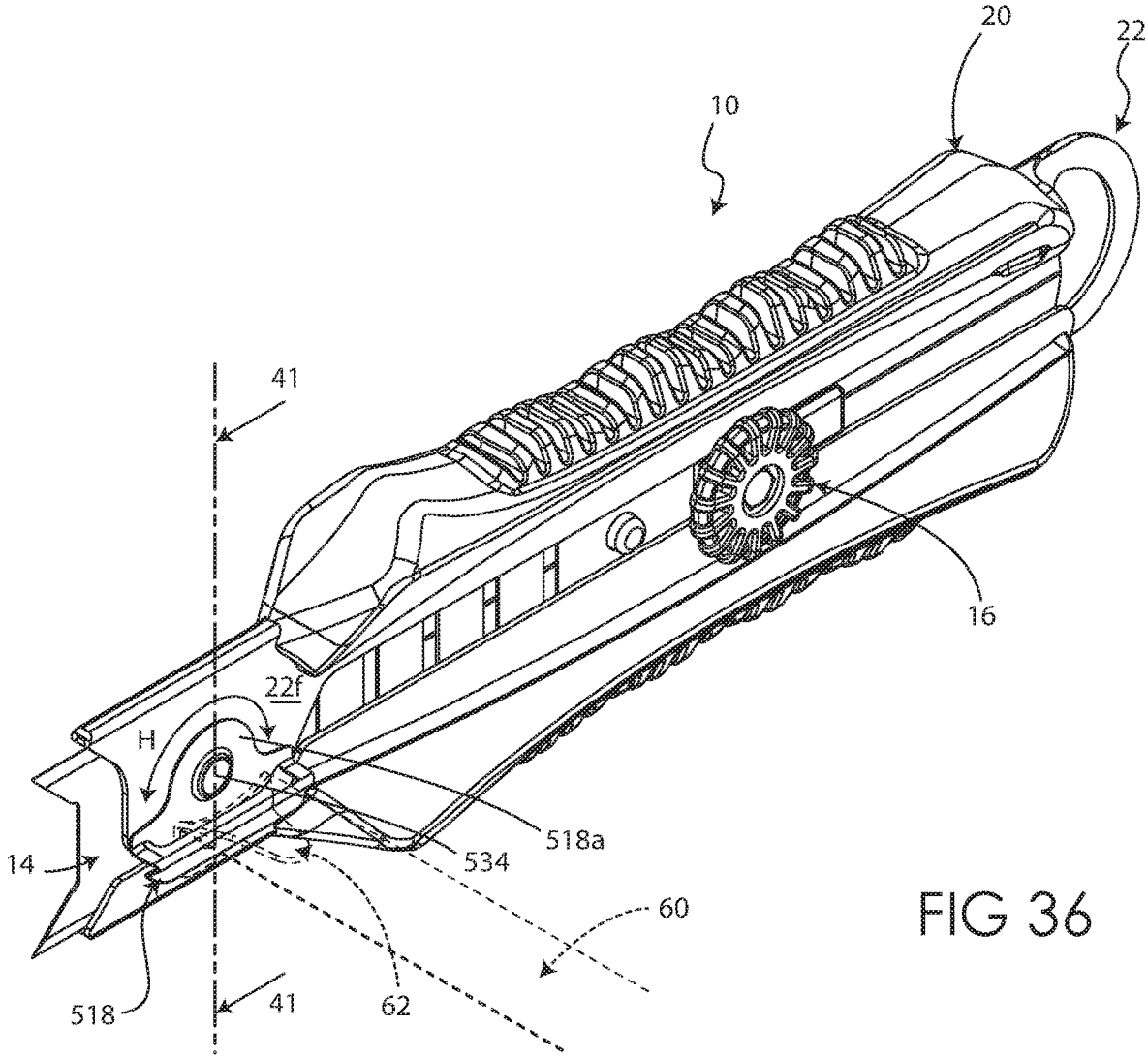
FIG. 36 is a top, front, left side, perspective view of the utility knife of FIG. 1 shown engaged with a fifth embodiment of a tape engagement clip in accordance with an aspect of the present disclosure.
Figure 37:
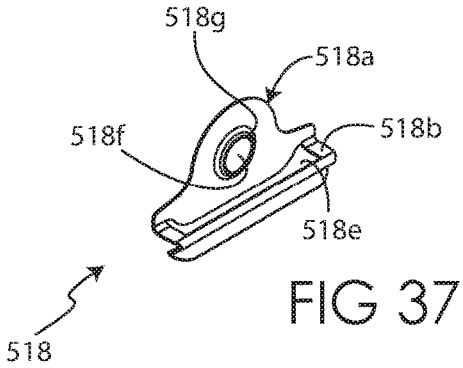
FIG. 37 is a top, front, left side, perspective view of the fifth embodiment tape engagement clip shown in FIG. 36.
Figure 38:
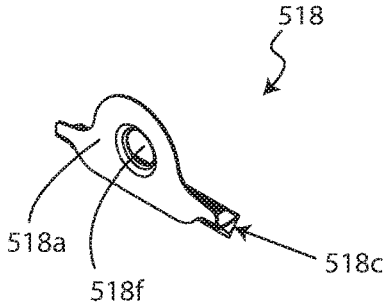
FIG. 38 is a top, rear, right side, perspective view of the tape engagement clip of FIG. 36.
Figure 39:
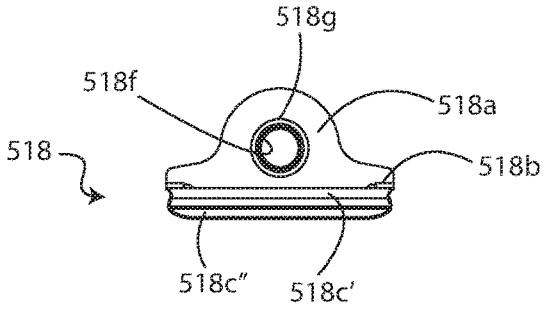
FIG. 39 is a front elevation view of the tape engagement clip of FIG. 36.
Figure 40:
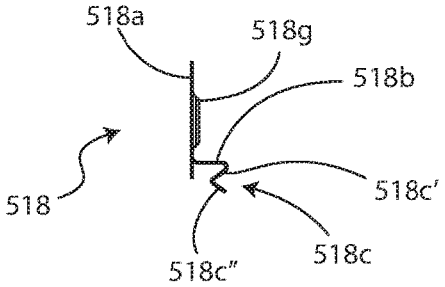
FIG. 40 is a left side elevation view of the tape engagement clip of FIG. 36.

FIGS. 3A and 3B show tape engagement clip 18 includes a first end 18*a*, a second end 18*b*, a first edge 18*c*, a second edge 18*d*, a first side wall 18*e* and second side wall 18*f* bound and define a passage 18*g* that has openings in first edge 18*c* and in second edge 18*d*. Aligned apertures 18*h* are defined in first side wall 18*e* and second side wall 18*f*. A tab 18*j* extends outwardly from first edge 18*c* of first side wall 18*e*. A fastener 34 has a head 34*a* and a shaft 34*b* (FIG. 36). Fastener 34 is utilized to secure tape engagement clip 18 to knife 10 by inserting shaft 34*b* through aperture 18*h* in first side wall 18*e* of tape engagement clip 18 and into the aperture 22*n* in one or the other of first side wall 22*e* or second side wall 22*f* of second housing section 22. FIGS. 11-13 show tape engagement clip 18 engaged with second side wall 22*f* of second housing section 22. FIG. 13 shows that tape engagement clip 18 is able to rotate about the shaft of fastener 34 through 360°. In other words, tape engagement clip 18 is able to rotate about an axis that is oriented at right angles to longitudinal axis "Y". This ability to rotate clockwise or counterclockwise is indicated by the arrow "C". A person will rotate tape engagement clip 18 to orient it correctly to engage with a measuring tape depending on whether they intend to use the cutting surface of second wall 14*d* of blade member 14 or the cutting surface of first wall 14*c* of blade member 14. This will be described hereafter.

Referring to FIGS. 13-18, knife 10 may be used in the following manner. Initially, blade member 14 may be retracted into the housing 12 so that neither cutting surface (14*c*, 14*d*) is able to be accidentally contacted. In a retracted position, the tips 14*g*, 14*h* of blade member are positioned inwardly of the tips 22*p*, 22*q* of second housing section 22. In order to advance the blade outwardly from the second housing section 22, the user will rotate the locking knob 32 of locking mechanism 16 in a counter-clockwise direction indicated by arrow "D" in FIG. 14 and will then push on the knob 32 to move the same in the direction indicated by arrow "E". In other words, the person will slide the knob 32 along the slot 22*g* in the direction of arrow "E". When the desired number of blade segments 14*k* extend outwardly beyond first end 22*a* of second housing section 22, the user will rotate the locking knob 32 of locking mechanism 16 in the opposite direction to arrow "D". This motion will bring the end of the shaft 32*b* of locking member 32 into contact with the first side wall 22*e* and prevent any further sliding movement of blade member 14 along second housing section 22.

Figure 14:
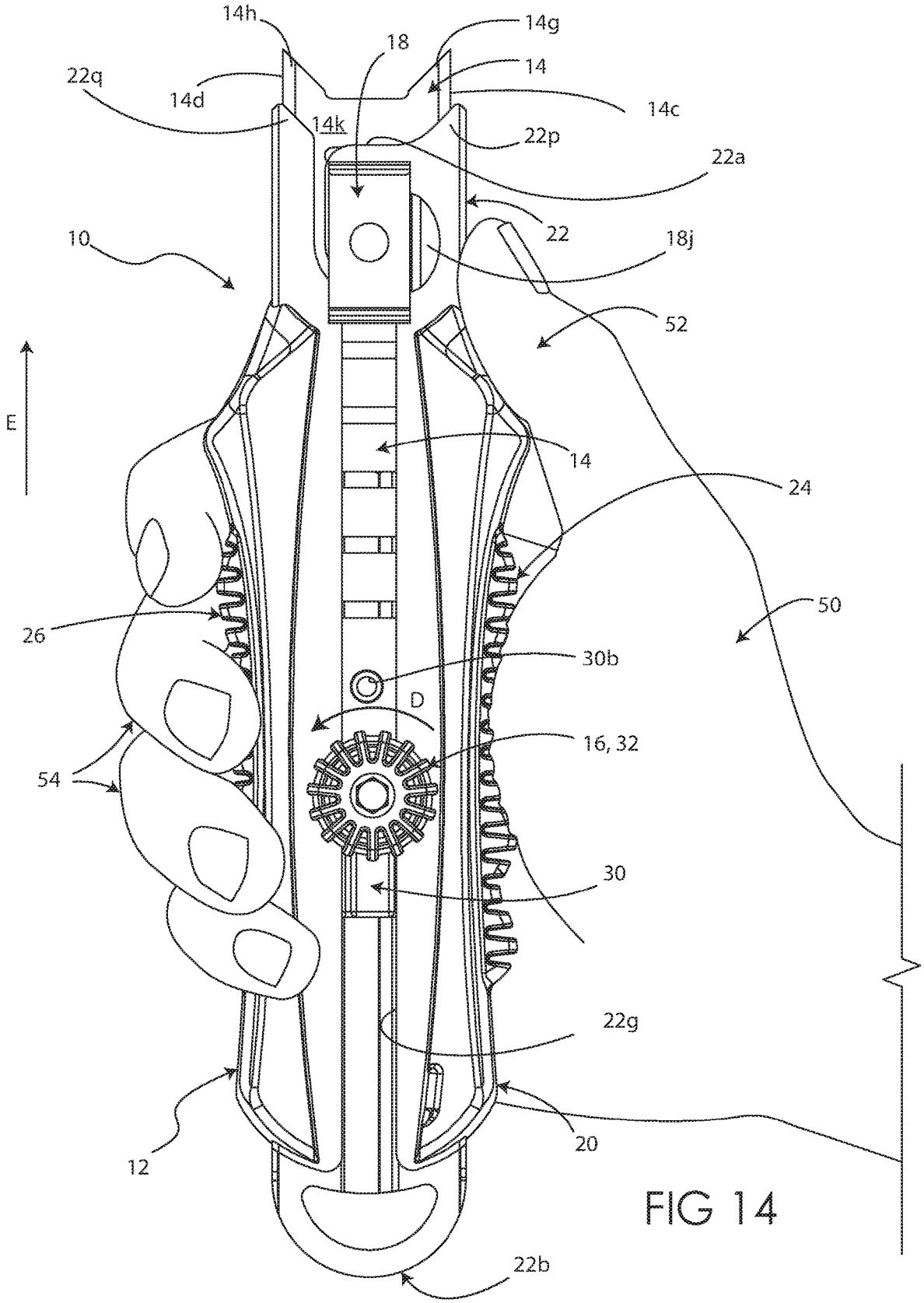
FIG. 14 is a left side elevation view showing the knife of FIG. 1 gripped in a person's right hand.

FIG. 14 shows knife 10 being gripped in a person's right hand 50. The person's palm contacts the first overmold 24, resting comfortably on the undulating hills and valleys of the first overmold 24. The person's fingers 54 curl around the first housing section 20 and rest on the undulating hills and valleys of the second overmold 26. In this orientation, the insides of the fingers will also rest comfortably on the third overmold 28 (which is not illustrated in FIG. 14). The pad of the person's thumb 52 rests on an upward-curving surface 20*j'* (FIG. 1) of V-shaped region 20*j* of first wall 20*c*, positioning the thumb to be able to apply downward force on knife 10. In the orientation shown in FIG. 14, the knife 10 is being readied to utilize the cutting surface of the second edge 14*d* of blade member 14. Tape engagement clip 18 is rotated so that the tab 18*j* extends away from the cutting surface to be used. In other words, the tape engagement clip 18 is oriented so that the tab 18*j* is located closest to the person's thumb 52 resting on surface 20*j'*.

It will be understood that, on other occasions, the knife 10 may be rotated through 180 degrees to present the cutting surface of the first edge 14*c* of blade member 14 to cut a surface. If this is the case, then the person's thumb pad will rest on the upward-curving surface 20*k'* (FIG. 2) of V-shaped region 20*k* of second wall 20*d*, their palm will contact the second overmold 26, and their fingers will rest on the first overmold. Additionally, tape engagement clip 18 will be rotated in either direction indicated by arrow "C" to position the tape engagement clip 18 opposite to the orientation shown in FIG. 14. In other words, the tab 18*j* will extend away from cutting surface 14*c* and will be positioned closest to the person's thumb 52 resting on curved surface 20*k'*. The person will then bring the desired cutting surface, 14*c*, or 14*d* (depending on how the knife 10 is being held) into contact with the surface to be cut and will slide the cutting surface along that surface to make the desired cut.

The surfaces 20*j'* and 20*k'* also advantageously position the person's thumb proximate the first side wall 22*e* and second side wall 22*f* of second housing section 22. Should the user not wish to engage a tape engagement clip 18 with knife 10, the location of surfaces 20*j'* and 20*k'* places the thumb in the correct position to hold the end of the measuring tape against one or the other of the first section wall 22*e* and second side wall 22*f*.

Additionally, when the pad of the person's thumb is resting on one or the other of the surfaces 20*j'* and 20*k'*, the locking knob 32*a* of locking mechanism 16 does not need to be positioned against the user's palm. In previously-known utility knives, if a left-handed user grasps the knife in the only orientation that can be used to cut a surface, the head of the locking knob will contact the user's palm. This contact causes the person to grip the previously-known utility knives awkwardly and this leads to premature fatigue of hand and wrist. In the presently known knife 10, the configuration of the second side wall sections 20*f'* and 20*f''* also helps to reduce the likelihood of the person contacting the head 32*a* of the locking knob 32 with their hand. The second side wall sections 20*f'*, 20*f''* angle outwardly away from each other and thus effectively recess at least a portion of the head 32*a* of the locking knob 32 a distance away from the user's palm. The effective recessing of the head 32*a* of the locking knob 32 can be seen in FIG. 7, for example.

Figure 15:
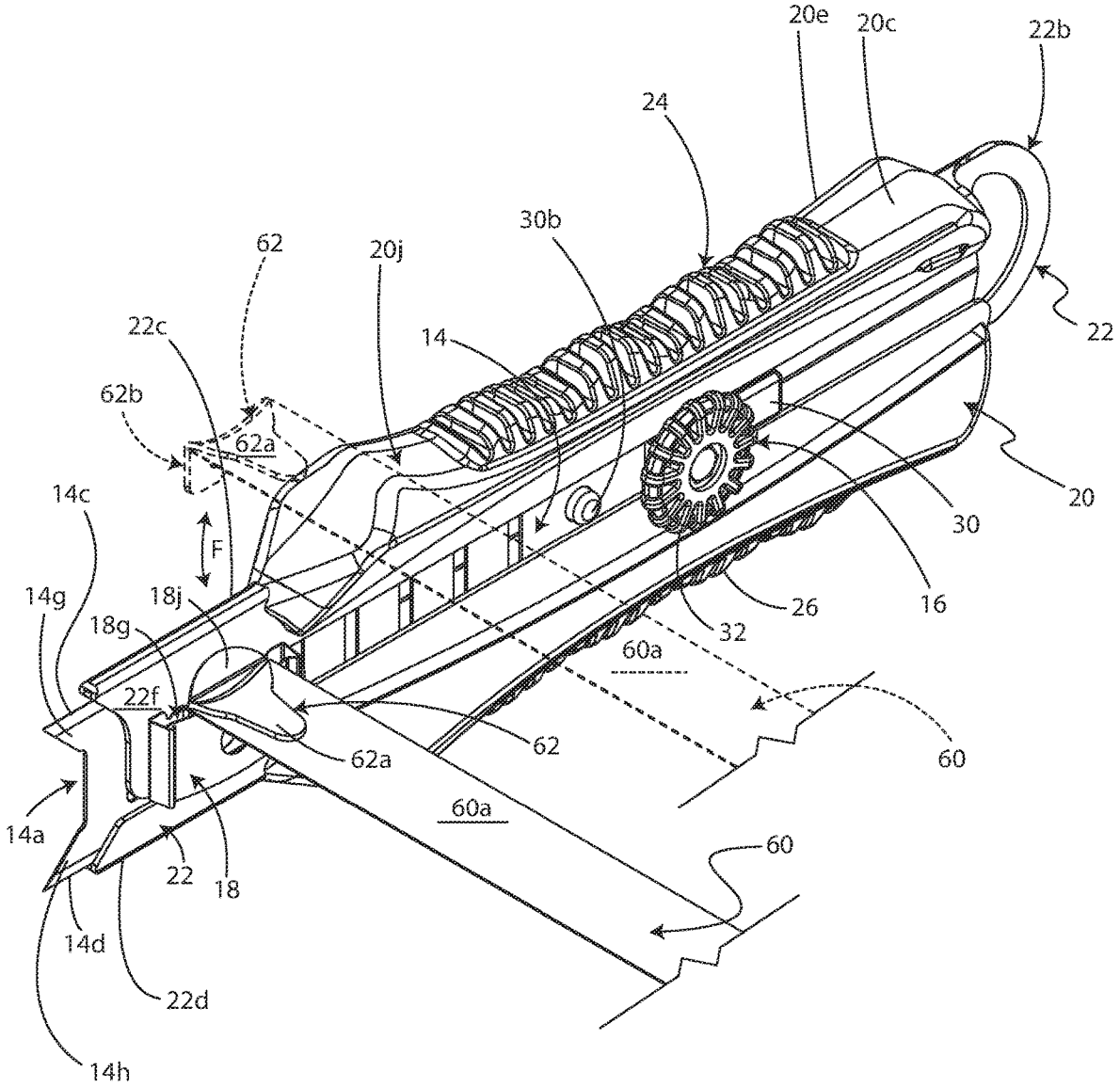
FIG. 15 is a top, front, left side, perspective view of the utility knife showing a measuring tape engaged with the tape engagement clip when the tape engagement clip is located on the second side wall of the second housing section.
Figure 16:
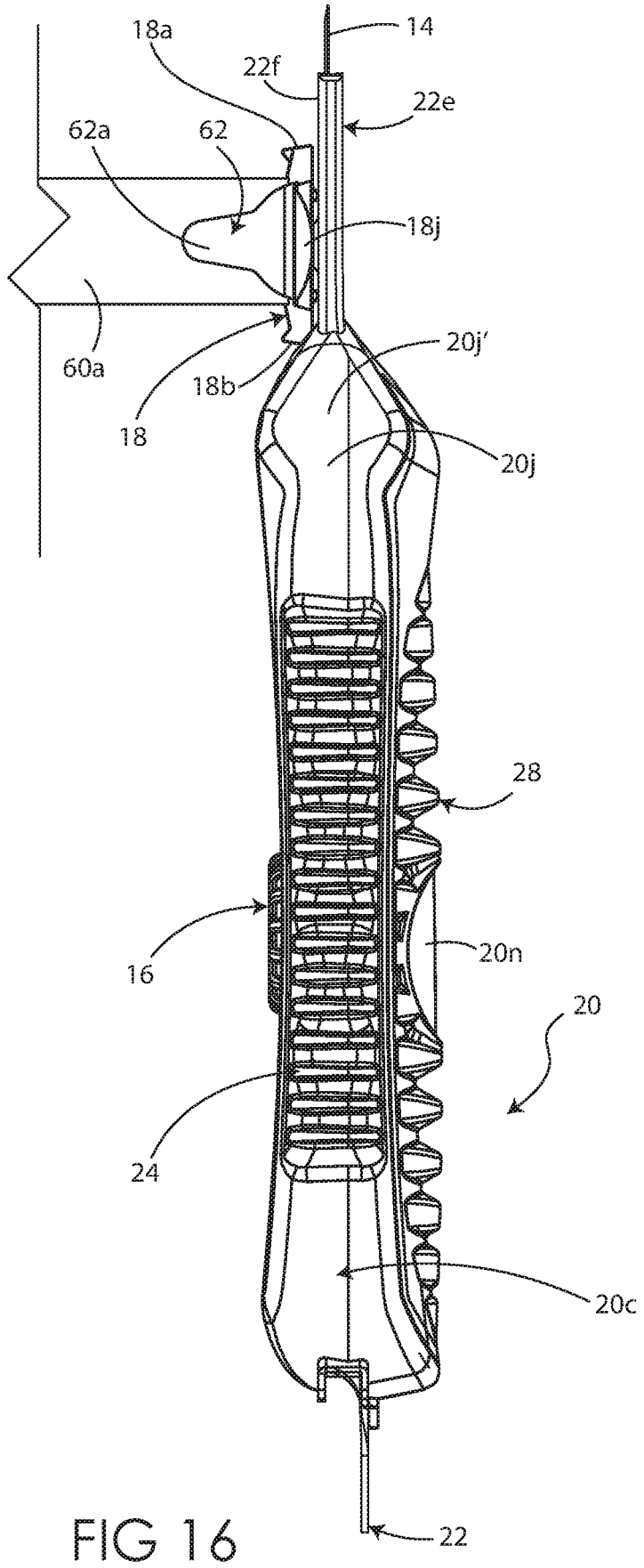
FIG. 16 is a top plan view of the utility knife and measuring tape shown in FIG. 15.

As indicated earlier herein, knife 10 is particularly well suited to cut drywall sheets. The person may desire to measure the width of the drywall sheet to be cut simultaneously with making the cut. In order to make this possible, the person will engage a measuring tape 60 with knife 10. This is shown in FIG. 15. Measuring tape 60 includes a flexible strip 60*a* which may extend outwardly from a housing (not shown) and includes a plurality of measurement markings thereon (not shown). The strip 60*a* is provided with rigid metal end 62 that has a horizontal first leg 62*a* engaged with the strip 60*a* and a vertical second leg 62*b* which extends outwardly at right angles to the strip 60*a*. In accordance with an aspect of the present disclosure, the person will firstly ensure that tape engagement clip 18 is in the correct orientation relative to which cutting surface 14*c*, 14*d* of blade member 14 is to be used. The person may grasp tab 18*j* to rotate the tape engagement clip 18 in either direction indicated by arrow "C" (FIG. 13. The person will then withdraw a length of the strip 60*a* of measuring tape 60 from the tape's housing (not shown) and will align the second leg 62*b* of the end 62 with the passage 18*g* defined in tape housing assembly 18. The person will then lower end 62 towards tape engagement clip 18 and cause the vertical second leg 62*b* thereof to enter passage 18*g* of tape engagement clip 18. This movement interlockingly engages measuring tape 60 with knife 10. The strip 60*a* of measuring tape 60 is held at ninety degrees to the longitudinal axis "Y" of the knife 10 by engaging end 62 with tape engagement clip 18.

Once measuring tape 60 is engaged with knife 10, the person is able to position a measurement marking on the strip 60*a* that is remote from the knife 10 and end 62 with an edge of a drywall sheet. The cutting surface of the knife 10 is then drawn along the drywall sheet cutting the same at the desired distance from the edge of the sheet. The knife 10 holds the end 62 of the measuring tape 60 to it, making it possible for the person to concentrate on measuring the desired distance more accurately instead of struggling to hold the end of the tape adjacent the knife as was done in the past. Because tape measuring assembly 18 is capable of rotating about the shaft of fastener 34, the tape 60 will not be twisted and rotated as the person seeks to properly angle the knife 10 to enable the blade member 14 to cut the surface of the drywall sheet. In some instances, for example, the measuring tape is oriented at 90 degrees relative to the drywall and the knife is perhaps oriented at an angle of about 45 degrees to the drywall. The fact that the tape engagement clip 18 is able to rotate or swivel about an axis oriented at right angles to the longitudinal axis "Y" helps to eliminate misalignment between measuring tape 60*a*, knife 10, and a sheet of drywall.

When it is no longer desired to engage measuring tape 60 with knife 10, the person will simply lift end 62 upwardly to withdraw second leg 62*b* out of passage 18*g*. The lowering of end 62 toward tape engagement clip 18 and the raising of end 62 from its engagement with tape engagement clip 18 is identified in FIG. 15 by the arrow "F".

Figure 17:
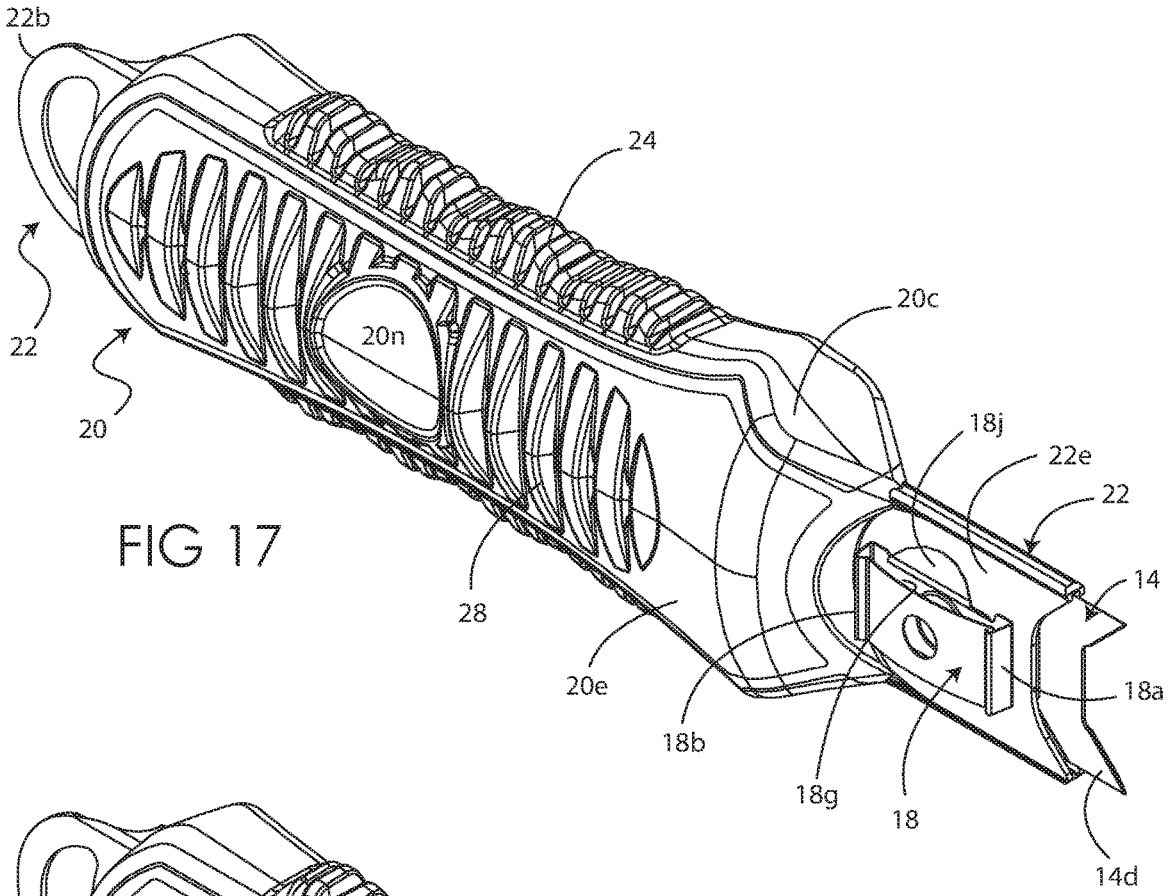
FIG. 17 is a top, front, right side, perspective view of the utility knife showing the tape measuring assembly engaged with the first side wall of the second housing section.
Figure 18:
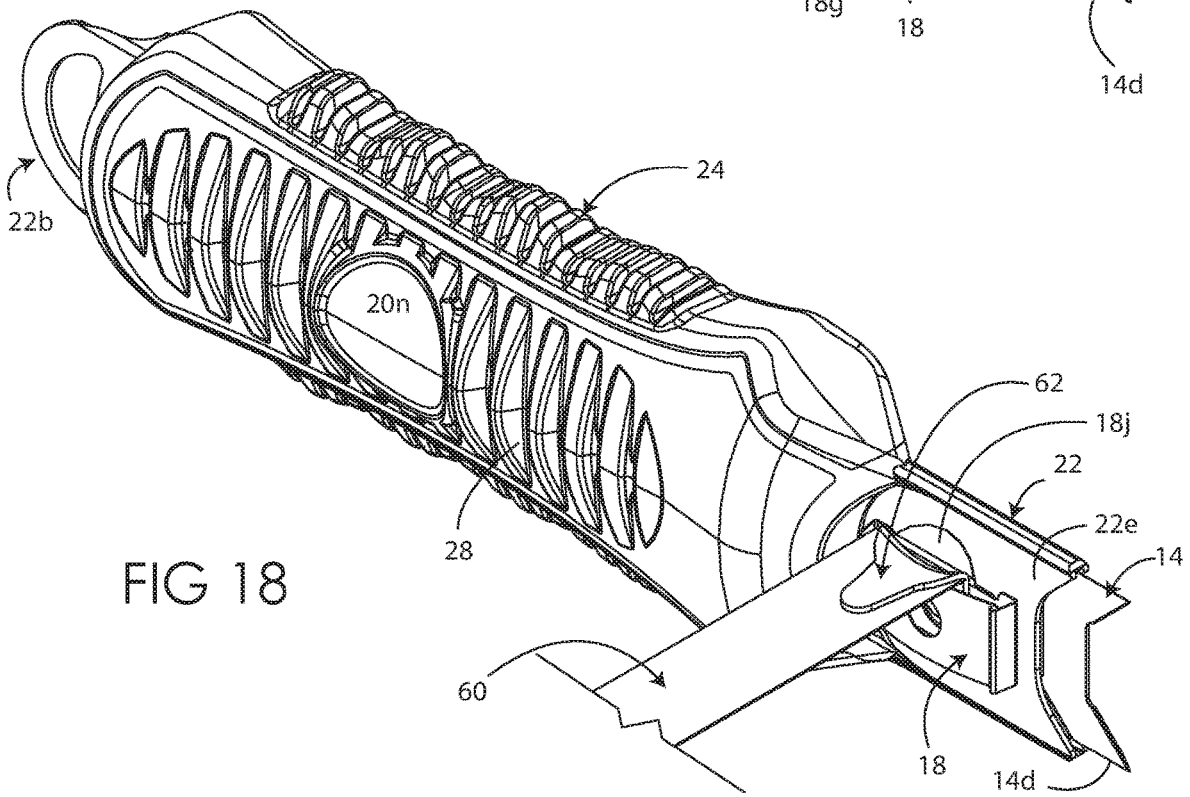
FIG. 18 is a top, front, right side, perspective view of the utility knife of FIG. 17 showing a measuring tape engaged with the tape engagement clip.
Figure 19:
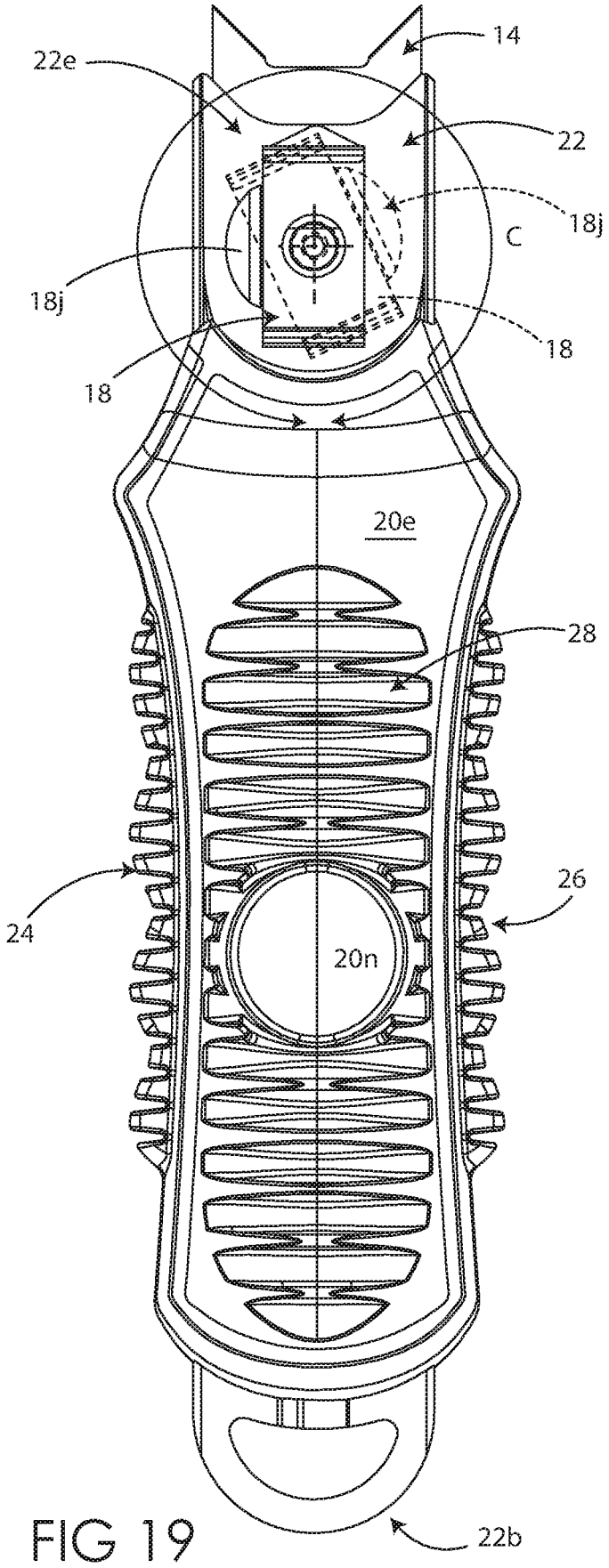
FIG. 19 is a right side elevation view showing the rotatability of the tape engagement clip located on the utility knife shown in FIG. 17.

FIGS. 17-19 show tape engagement clip 18 engaged with the first side wall 22*e* of second housing section 22. In order to remove tape engagement clip 18 from the second side wall 22*f* (shown in FIG. 16), the person will simply position their thumb against a first end 18*a* of tape engagement clip 18 and will position their index finger against second end 18*b* thereof and will pull tape engagement clip 18 outwardly at right angles to second side wall 22*f* to disengage fastener 34 from hole 22*n* (FIG. 3A). Tape engagement clip 18 will then positioned with its first wall 18*e* in contact with first side wall 22*e* and the shaft of fastener 34 aligned with hole 22*n* in first side wall 22*e*, and then person will then push tape engagement clip 18 toward first side wall 22*e* to snapfittingly engage fastener 34 in hole 22*n*. The person is able to manipulate tape engagement clip 18 into the desired orientation by grasping tab 18*j* and rotating assembly 18 in either direction indicated by arrow "C" in FIG. 19. A measuring tape 60 may then be engaged with tape engagement clip 18 as previously described.

Figure 20A:
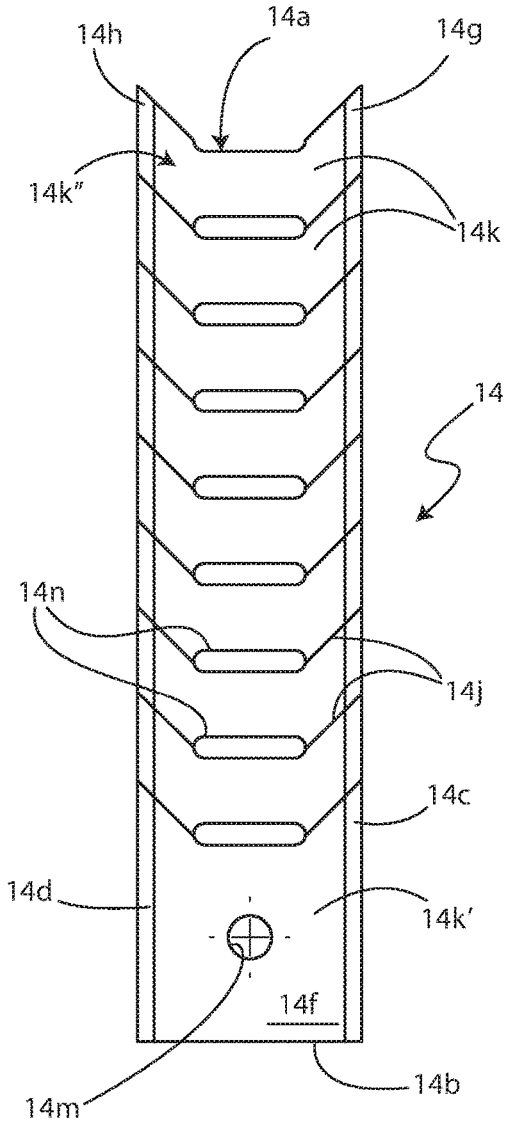
FIG. 20A is a left side elevation view of the first embodiment of a blade member in accordance with the present disclosure shown on its own.
Figure 20B:
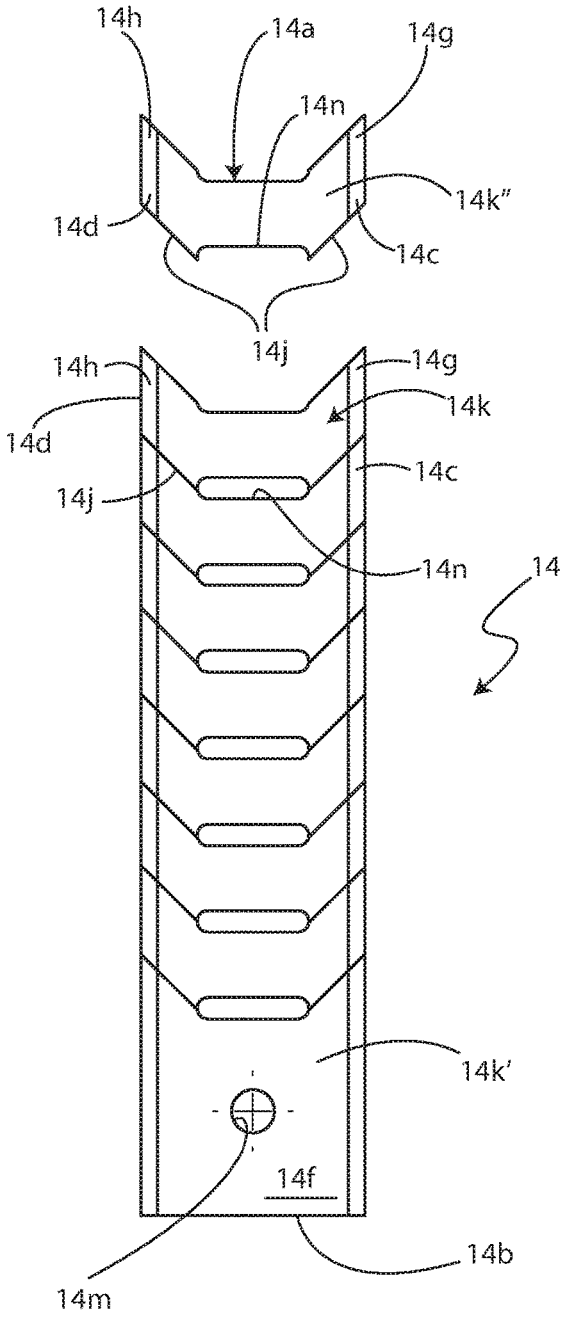
FIG. 20B is a left side view of the first embodiment of the blade member showing a dulled blade segment broken off therefrom.

FIGS. 20A and 20B, show the first embodiment blade member 14 on its own. FIG. 20A shows a new/replacement blade member 14 that comprises a plurality of blade segments 14*k* that are separated from each other by lines of weakness 14*j*. The first end 14*c* and the second edge 14*d* both present sharpened cutting surfaces. FIG. 20B shows the leading blade segment 14*k*" snapped off of the rest of the blade member 14. This will be done when the portions of the cutting surfaces 14*c*, 14*d* that are present on blade segment 14*k*" have become too dull for use. The blade segment 14*k*" is able to be snapped off the rest of blade member 14 in the same manner as in previously known utility knife blades. When blade segment 14*k*" is removed from blade member 14, the new leading blade segment 14*k* includes sharped cutting surfaces on each of the first and second edges 14*c*, 14*d* and includes tips 14*g* and 14*h*. In other words, the new leading blade segment 14*k* is identical to the removed blade segment 14*k*".

When all of the blade segments 14*k* have been removed from blade member 14 except blade segment 14*k*' (i.e., the rearmost segment), and the cutting surfaces 14*c*, 14*d* of rearmost blade segment 14*k*' are too dull for use, blade member 14 may be disengaged from carriage 30 and a new blade member (such as the one illustrated in FIG. 20A may be engaged with carriage 30.

Figure 21A:
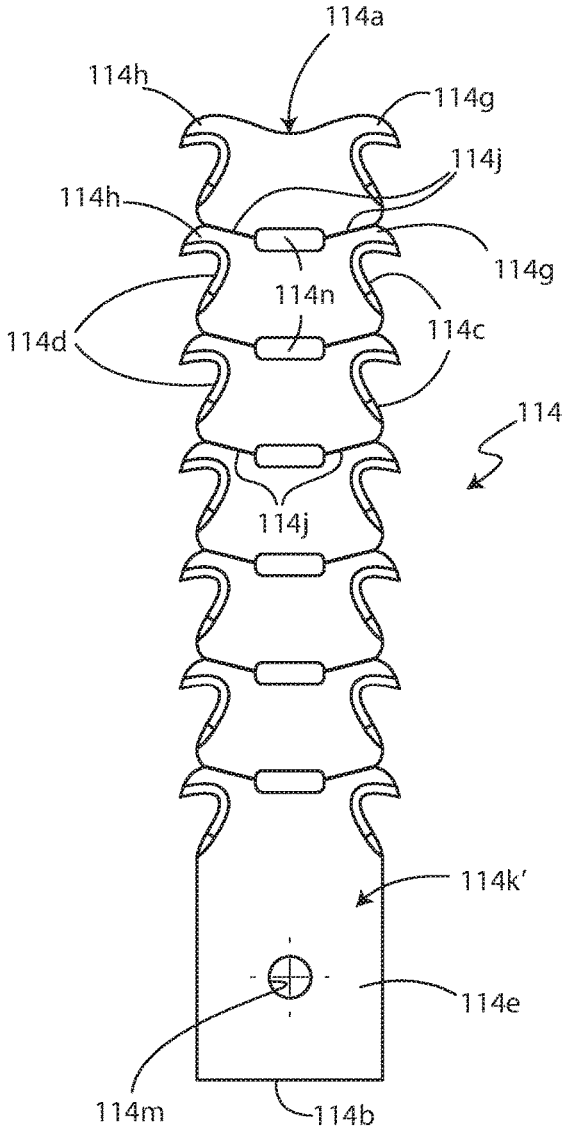
FIG. 21A is a front elevation view of a first side of a second embodiment of a blade member in accordance with the present disclosure shown on its own.
Figure 21B:
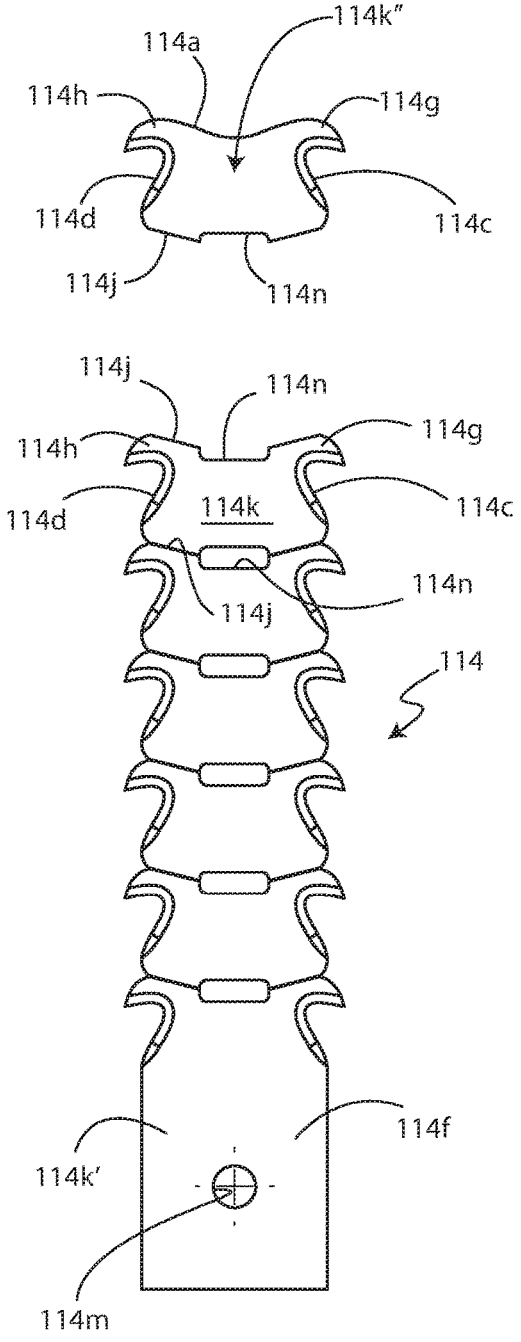
FIG. 21B is a front elevation view of a second side of the second embodiment of the blade member showing a dulled segment blade broken off therefrom.

FIGS. 21A and 21B show a second embodiment blade member 114 that may be utilized with knife 10. Blade member 114 comprises a planar sheet of metal which has a first end 114*a*, a second end 114*b*, a first edge 114*c*, a second edge 114*d*, a first side 114*e* (FIG. 21A), and a second side 114*f* (FIG. 21B). A plurality of lines of weakness 14*j* are defined along blade member extending from first edge 114*c* to second edge 114*d*. The lines of weakness divide blade member 114 into a plurality of blade segments 114*k* that are substantially identical in configuration to each other with the exception of the rearmost blade segment 114*k*'. A hole 114*m* is defined in rearmost blade segment 114*k*' that is utilized in the same manner as hole 14*m* in rearmost blade segment 14*k*' to help engage blade member 114 to carriage 30 of knife 10. An aperture 114*n* is defined centrally in each line of weakness 114*j* and performs the same function as the aperture 14*n* in blade member 14.

First end 114*a* of blade member 114 (and all lines of weakness 114*j*) is generally U-shaped. First and second edges 114*c*, 114*d* together with first end 114*a* form two J-shaped tips 114*g*, 114*h* that are oriented as mirror images of each other on each blade segment 114*k* of blade member 114. These hook-shaped tips 114*g*, 114*h* are particularly useful for cutting surfaces such as roofing shingles.

Blade member 114 is utilized in knife 10 in exactly the same manner as blade member 14. When cutting surfaces 114*c*, 114*d* become dulled on the leading blade segment 114*k*", that segment is simply snapped off blade member 114. The blade segment which then forms the leading edge of blade member 114 is substantially identical to the removed blade segment 114*k*". When the rearmost blade segment's cutting surfaces become dulled, rearmost blade segment 14*k*' is disengaged from the carriage 30 on knife 10 and a new, replacement blade segment 114 (or blade segment 14) is engaged therewith.

Additionally, unlike previously-known blade members used with previously-known utility knives, both first edge 114*c* and the second edge 114*d* of blade member 114 are sharpened to form cutting surfaces. In previously-known blade members, only the bottom edge is sharpened into a cutting surface. Because of the presence of two cutting surfaces 114*c*, 114*d* and two tips 114*g*, 114*h*, blade member 114, and thereby knife 10, is capable of being used in two different orientations that are 180 degrees apart. Previously-known utility knives have only been able to be used in a single orientation and that is with the single sharpened cutting surface (i.e., the sharped bottom edge) of the previously-known blade members positioned to contact a surface to be cut. With the presently-disclosed knife 10, either of the sharpened cutting surfaces of the first edge 114*c* and the second edge 114*d* may be brought into contact with a surface to be cut.

The presence of these two cutting surfaces on a single blade segment 14*k*, 114*k* means that the knife 10 that includes blade member 14 or 114 can be used for twice as long as previously known knives without requiring the user to snap off a blade segment or to physically open the knife housing to rotate the presented blade segment through 180° to present a fresh, sharp cutting surface for use.

It will be understood that other differently configured blade members may be utilized with knife 10, where those other differently configured blade members have two opposed cutting surfaces other than the V-shaped or J-shaped configurations disclosed herein. For example, a different type of blade member (not shown) may include one V-shaped tip (such as tip 14*g* or 14*h*) and one J-shaped tip (such as tip 114*g* or 114*h*).

Referring now to FIGS. 22-27 there is shown a second embodiment of a knife in accordance with the present disclosure that includes a second embodiment tape engagement clip. The second embodiment knife is indicated in these figures by the reference number 210 and the second embodiment tape engagement clip is indicated by the reference number 218. Knife 210 is substantially identical in structure and function to knife 10 except for the leading end of the second housing section 222. First housing section 220 and locking mechanism 216 are identical to first housing section 20 and locking mechanism 16 and therefore will not be further discussed with respect to FIGS. 22-27. A blade member 14 is shown engaged with knife 210 but blade member 114 (FIG. 21A or 21B) may be utilized therewith instead.

Figure 25:
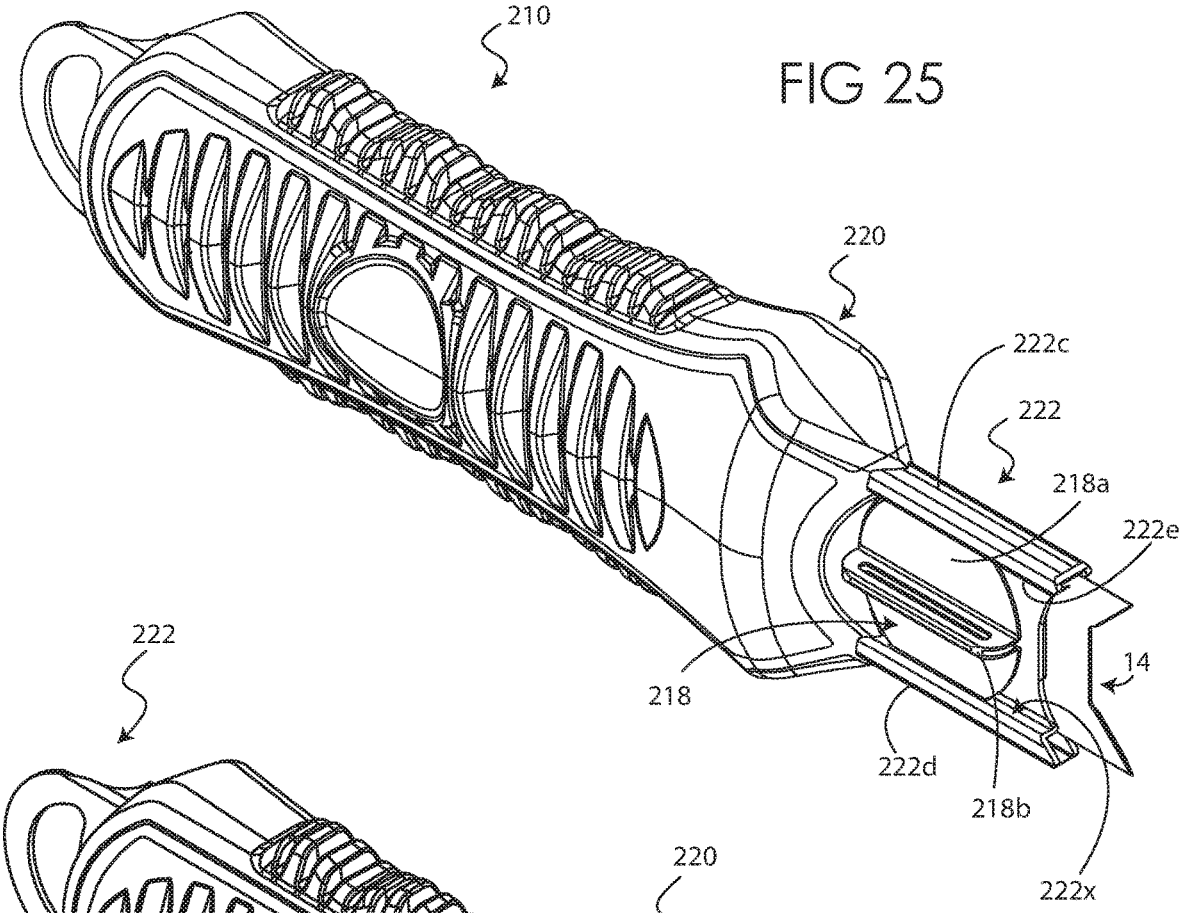
FIG. 25 is a top, front, right side, perspective view of the second embodiment of utility knife shown engaged with the second embodiment of the tape engagement clip.
Figure 26:
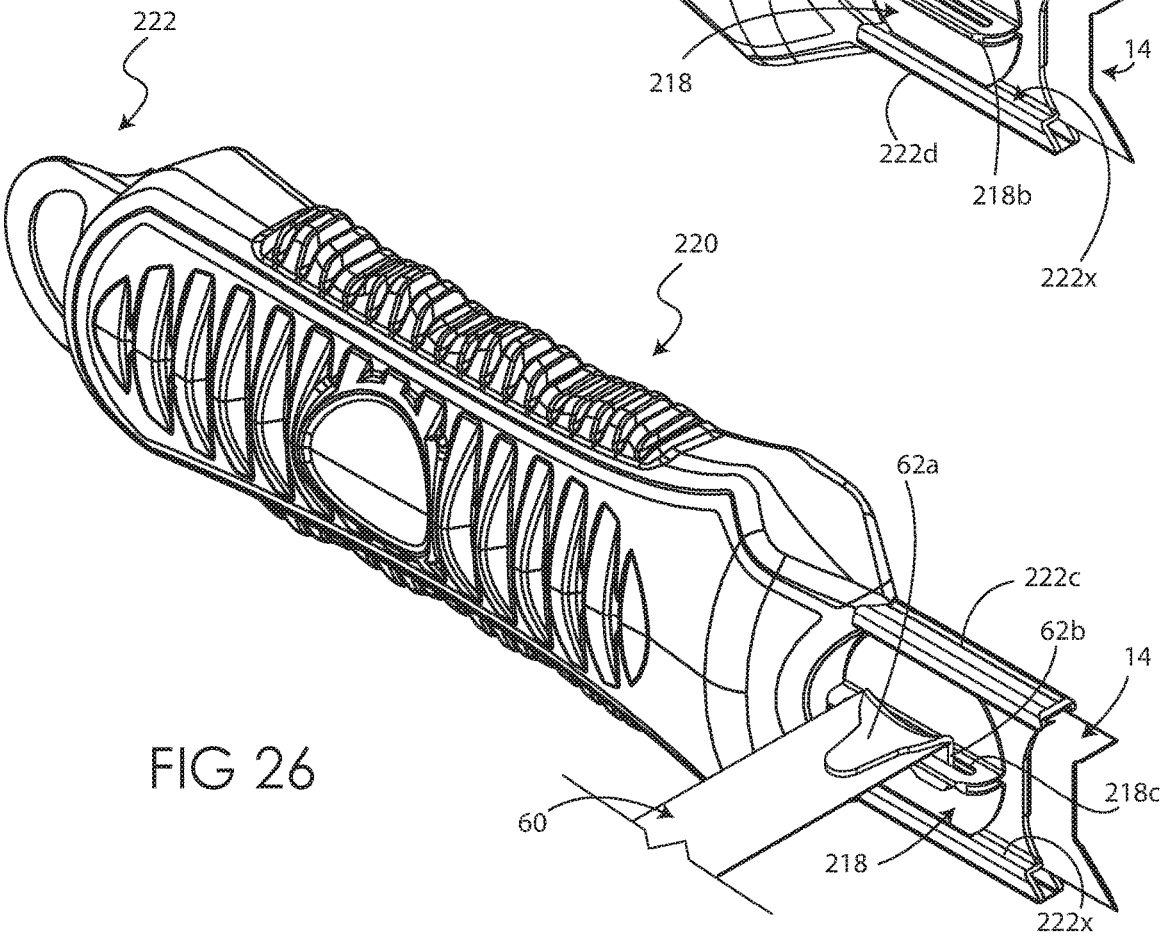
FIG. 26 is a top, front, right side, perspective view of the knife of FIG. 25 engaged with a measuring tape.
Figure 27:
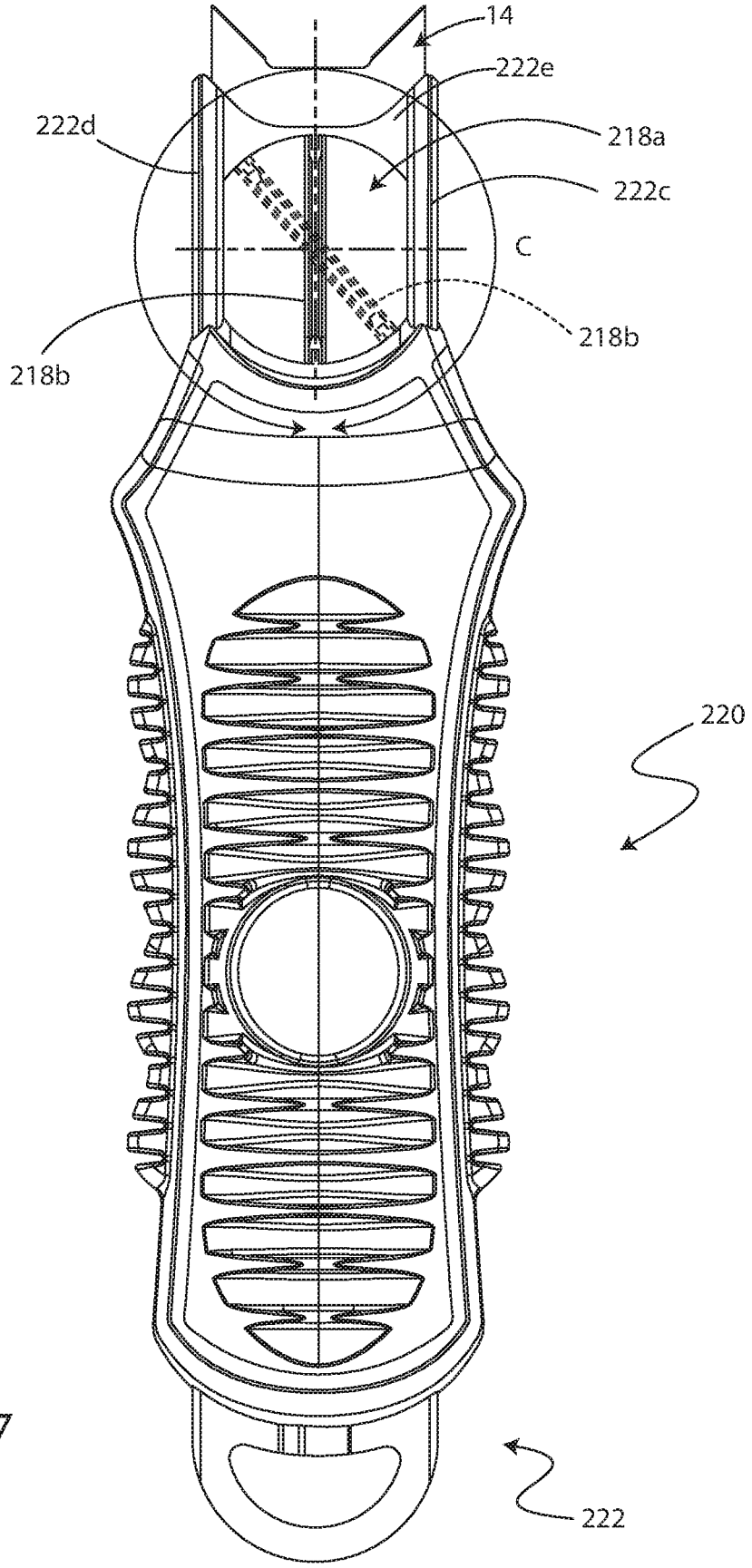
FIG. 27 is a right side elevation view of the knife of FIG. 25.

Second housing section 222 is substantially identical to second housing section 22 in structure and function except for the portions of first wall 222*c* and second wall 222*d* that extend outwardly and forwardly from the first end 220*a* of first housing section 220. The portions of first wall 222*c* and second wall 222*d* are wider (measured between first side wall 222*e* shown in FIG. 25 and second side wall 222*f* shown in FIG. 22). First wall 222*c* and second wall 222*d* each define a pair of laterally-spaced, longitudinally-oriented channels therein, such as channels 222*t* (FIGS. 22 and 23) and 222*x* (FIGS. 25 and 26). The channels 222*t*, 222*x* in first wall 222*c* and second wall 222*d* are vertically aligned with each other and are opposed. The purpose of channels 222*t*, 222*x*) will be discussed further below.

Figure 22:
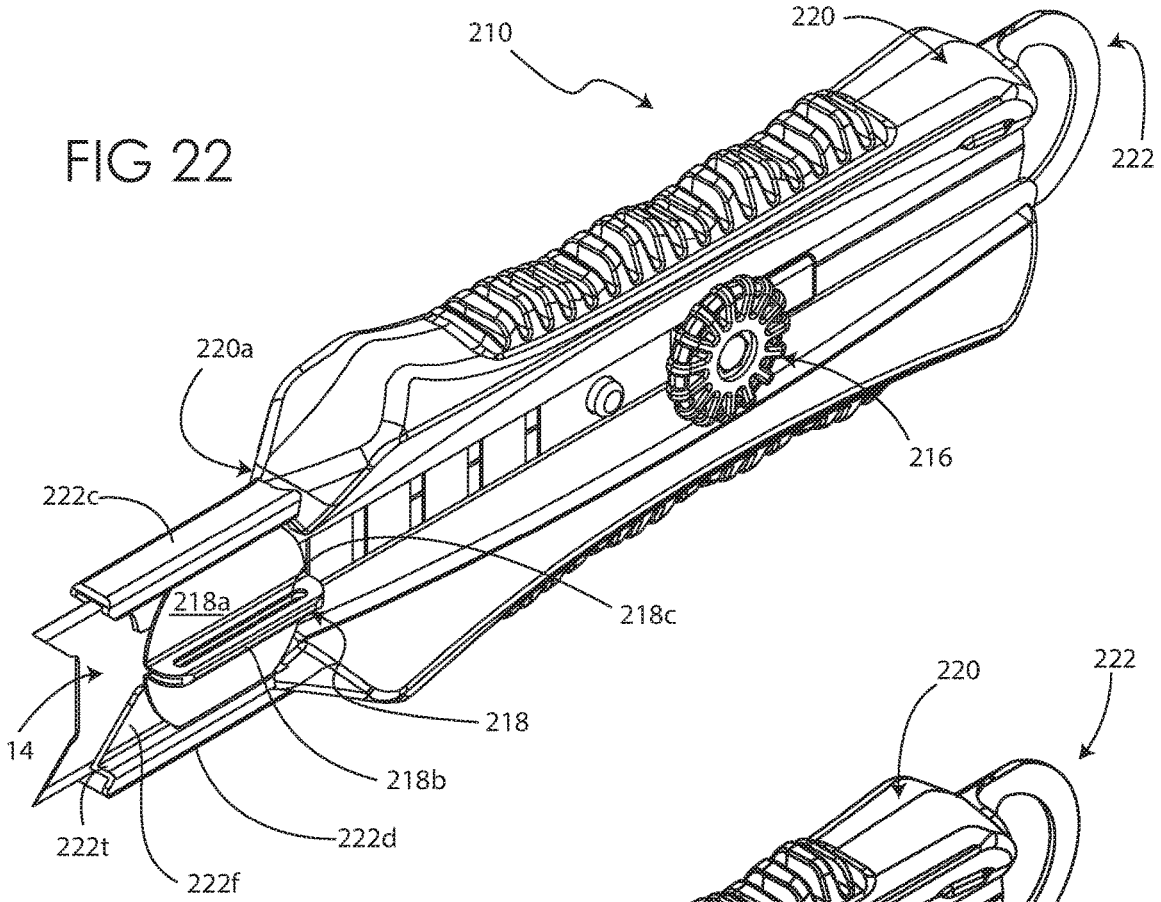
FIG. 22 is a top, front, left side, perspective view of a second embodiment of utility knife in accordance with an aspect of the present disclosure shown engaged with a second embodiment of a tape engagement clip.
Figure 23:
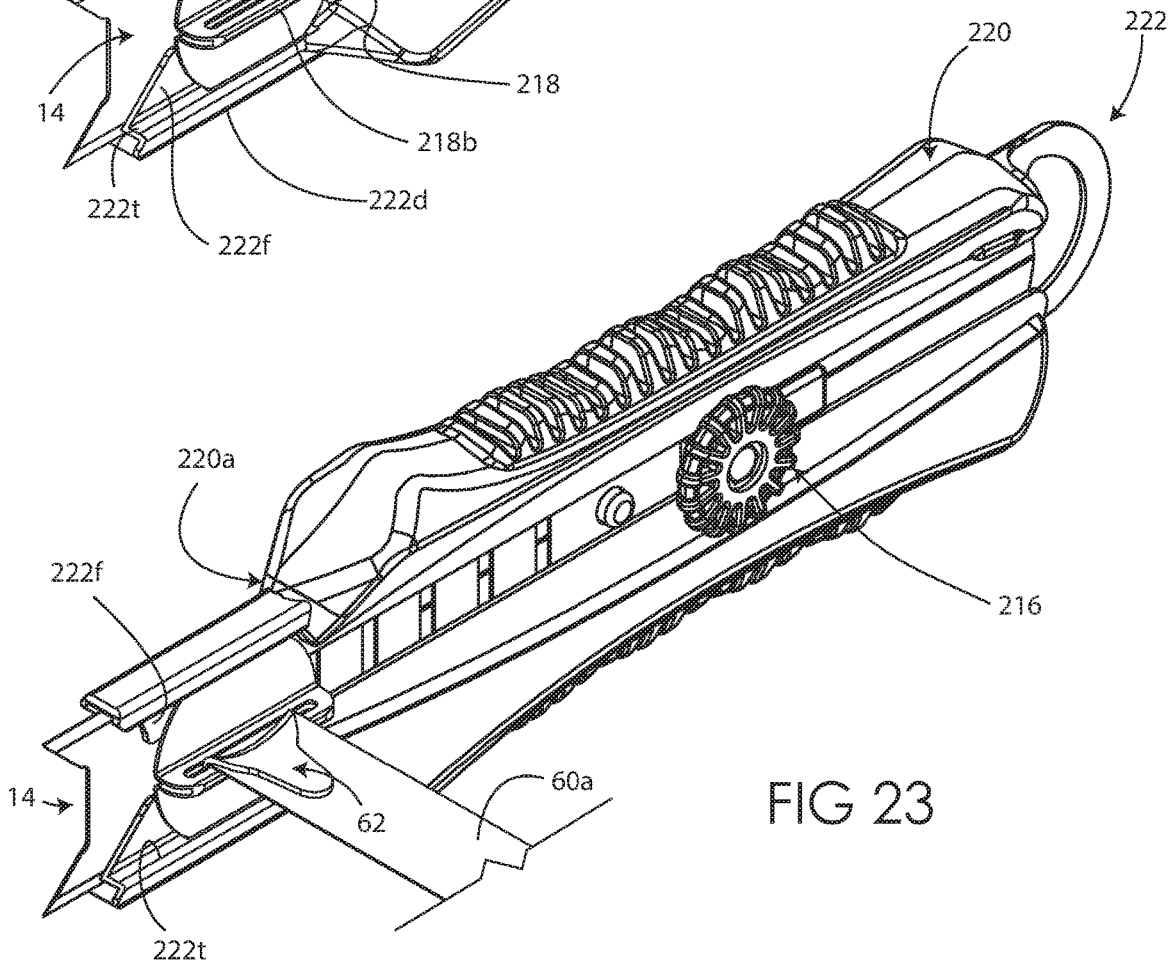
FIG. 23 is a top, front, left side, perspective view of the knife of FIG. 23 engaged with a measuring tape.
Figure 24:
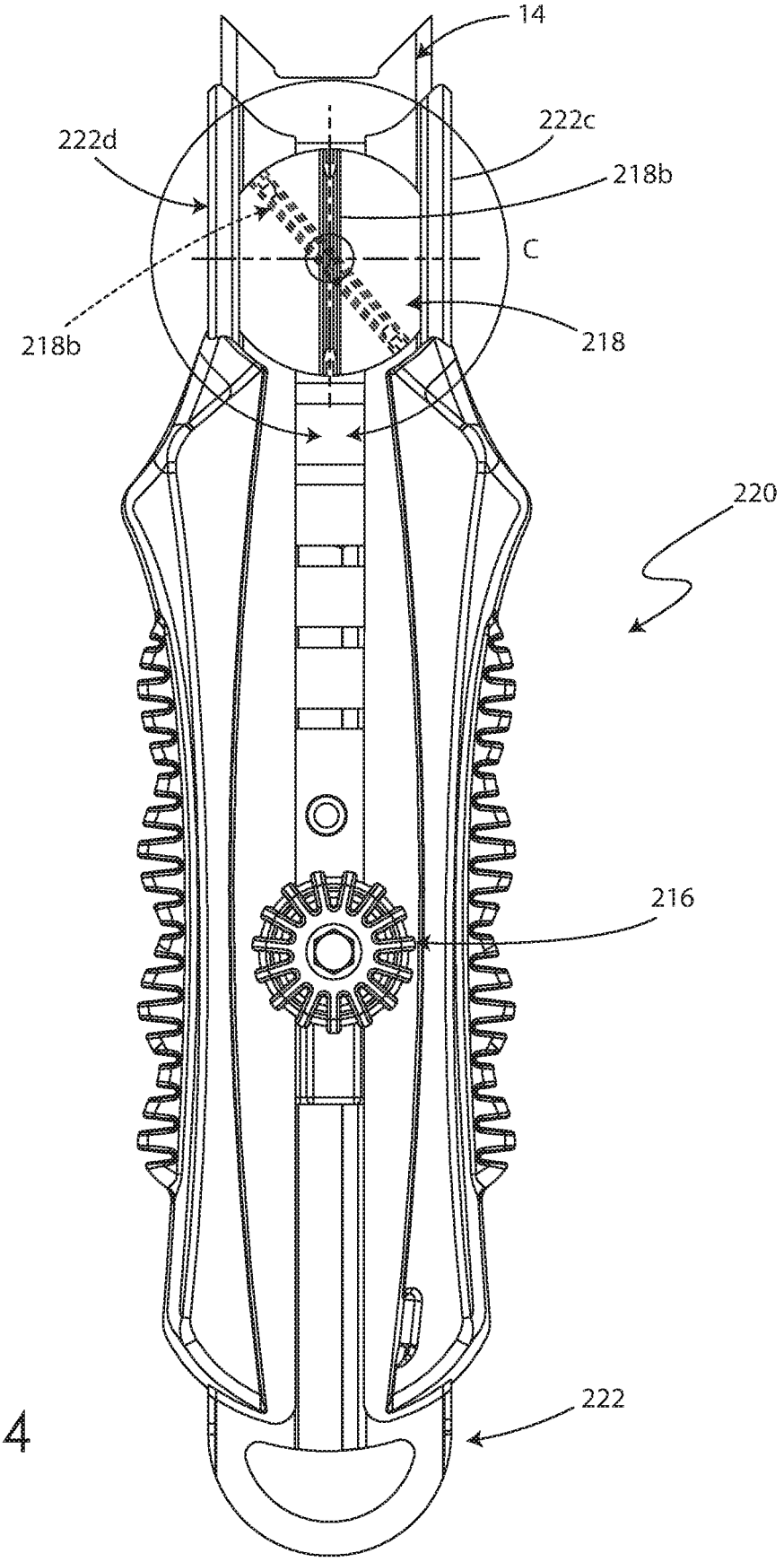
FIG. 24 is a left side elevation view of the knife of FIG. 23.

Tape engagement clip 218 comprises a plate 218*a* and a flange 218*b* that extends outwardly from an outer surface of plate 218*a*. Plate 218*a* is substantially circular in shape, and flange 218*b* is oriented at right angles to the outer surface of plate 218*a*. Flange 218*b* is formed by creating a fold in the material utilized to form plate 218*a* although in other embodiments, flange 218*b* may be welded or otherwise secured to outer surface of plate 218*a*. Flange 218*b* preferably is oriented along a diameter of plate 218*a* although this is not necessary. As shown in FIG. 22, flange 218*b* defines a passage 218*c* that extends from a first surface of flange 218*b* through to a second surface thereof. Passage 218*c* is sufficiently long enough and wide enough to receive the vertical leg of the end 62 of a measuring tape 60 therethrough as shown in FIG. 22.

Plate 218*a* is of a thickness (measured between the outer surface and an inner surface thereof) that is complementary to the width of channels 222*t*, 222*x*. Plate 218*a* is received in opposed channels 222*t* in first and second walls 222*c*, 222*d* such that the inner surface of plate 218*a* is placed in abutting contact with second side wall 222*f* as shown in FIG. 22 Alternatively, tape engagement clip 218 may be engaged in channels 222*x* in first and second walls 222*c*, 222*d* such that the inner surface of plate 218*a* is placed in abutting contact with first side wall 222*e* (FIGS. 25-28). Plate 218*a* may be rotated within the opposed channels 222*t* or 222*x* as indicated by the arrow "C" in FIG. 24 or FIG. 27. In other words, plate 218*a* may be rotated about an axis extending at right angles to longitudinal axis "Y". The rotation of plate 218*a* may be accomplished by the user grasping flange 218*b* between their thumb and index finger and rotating the same. Tape measuring assembly 218 may be moved between the position shown in FIG. 22 and the position shown in FIG. 25 simply by sliding plate 218*a* out of the aligned opposed channels 222*t* or 222*x*, rotating the plate 218*a* through 180°, and then reinserting the plate 218*a* into the other of the channels 222*t*, 222*x* on the opposite side of second housing section 222. Knife 210 is used in substantially the same manner as knife 10.

Figure 28:
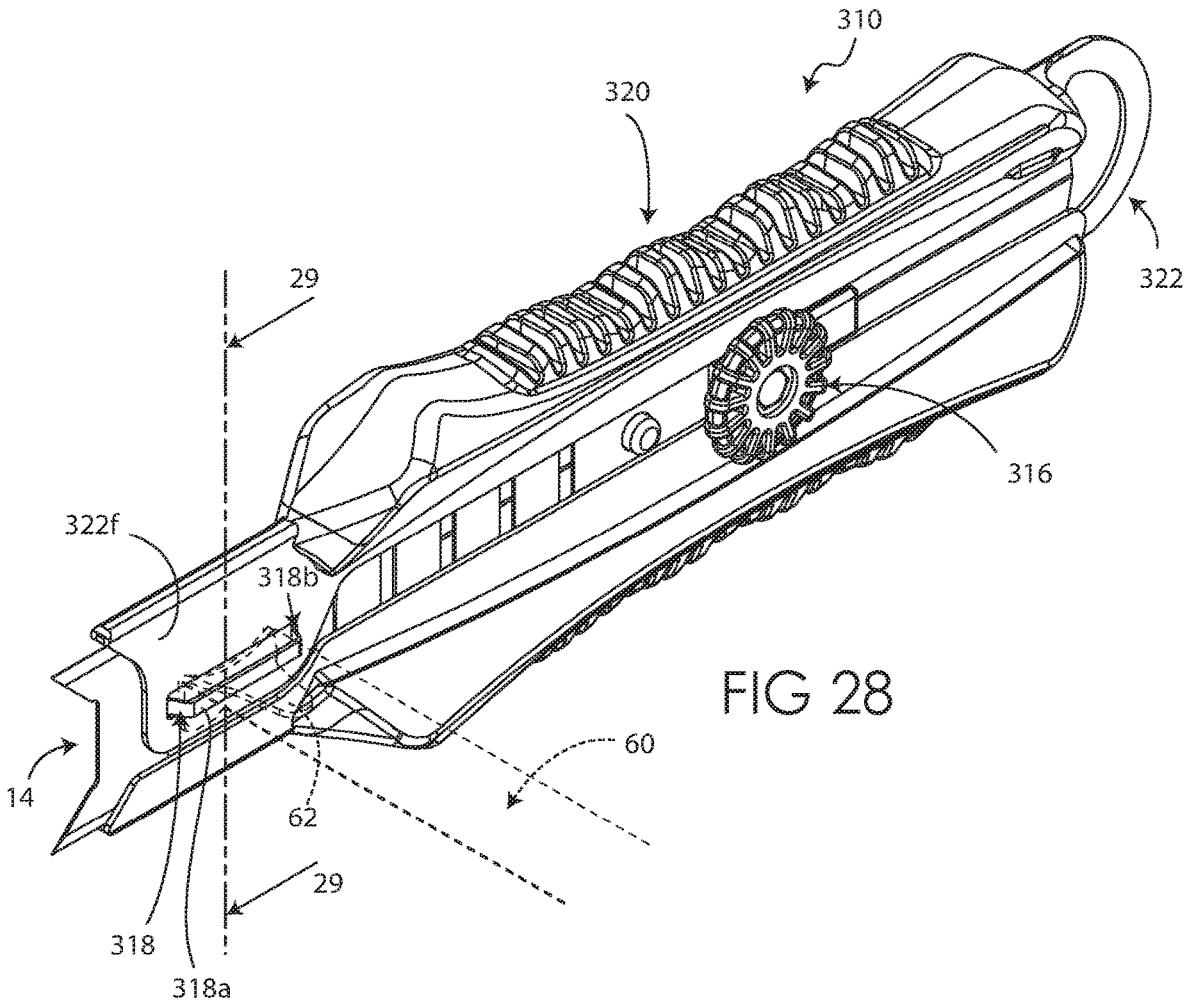
FIG. 28 is a top, front, left side, perspective view of a third embodiment of utility knife in accordance with an aspect of the present disclosure shown engaged with a third embodiment of a tape engagement clip.
Figure 29:
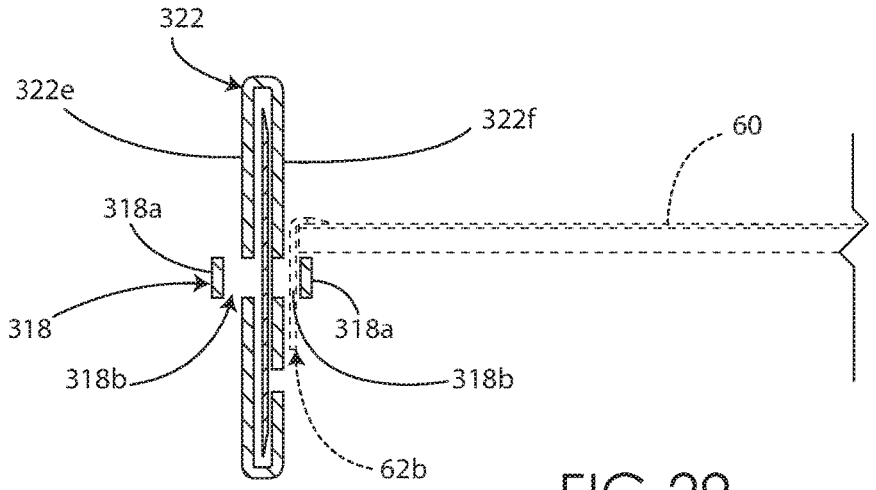
FIG. 29 is a cross-section of the utility knife and tape engagement clip taken along line 29-29 of FIG. 28.

Referring now to FIGS. 28 and 29 there is shown a third embodiment of a knife in accordance with the present disclosure which includes a third embodiment tape engaging assembly. The third embodiment knife is indicated in these figures by the reference number 310 and the third embodiment tape engagement clip is indicated by the reference number 318. Knife 310 is substantially identical in structure and function to knife 10 except for the leading end of the second housing section 322. First housing section 320 and locking mechanism 316 are identical to first housing section 20 and locking mechanism 16 and therefore will not be further discussed with respect to FIGS. 28 and 29. A blade member 14 is shown engaged with knife 310 but blade member 114 (FIG. 21A or 21B) may be utilized therewith instead.

Second housing section 322 is substantially identical to second housing section 22 except that the aligned holes 22*n* are missing. The third embodiment tape engagement 318 assembly comprises a U-shaped bracket 318*a* that defines a passage 318*b* between the bracket and one of the first side wall 322*e* and the second side wall 322*f*, or each of the first side wall 322*e* and second side wall 322*f*. Bracket 318*a* is oriented substantially parallel to the longitudinal axis "Y" of knife 10. The passage 318*b* is of a sufficient length and width to receive the vertical leg of the end 62 of measuring tape 60 therethrough, as has been previously described herein. Unlike the first and second embodiments of tape engaging clip 18, 218, the presently disclosed third embodiment of the tape engaging clip 318 is not able to rotate about an axis oriented at right angles to longitudinal axis "Y".

Referring now to FIGS. 30-35, utility knife 10 is shown with a fourth embodiment tape engaging clip engaged therewith. Utility knife 10 is identical to the knife 10 illustrated and described with reference to FIGS. 1-19. The fourth embodiment tape engagement clip is indicated by the reference number 418.

Figure 34:
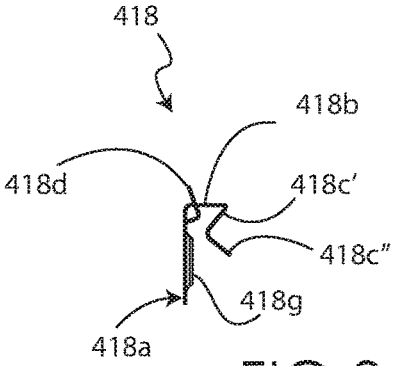
FIG. 34 is a left side elevation view of the tape engagement clip of FIG. 30.

FIGS. 31-34, particularly FIG. 34, shows that tape engagement clip 418 is integrally formed from a single plate of metal that has been bent into a generally U-shaped end product. In particular tape engagement clip 418 includes a vertical first leg 418*a*, a horizontal second leg 418*b*, and a generally vertically-oriented third leg 418*c* that has been bent into an L-shape. In particular, the L-shaped third leg has a first region 418*c*' extending inwardly from second leg 418*b*, and a second region 418*c*" extending outwardly from first region 418*c*'. The L-shaped third leg 418*c* extends for a distance outwardly from second housing section 22 and enables a user to readily grasp and manipulate tape engagement clip 418.

Figure 30:
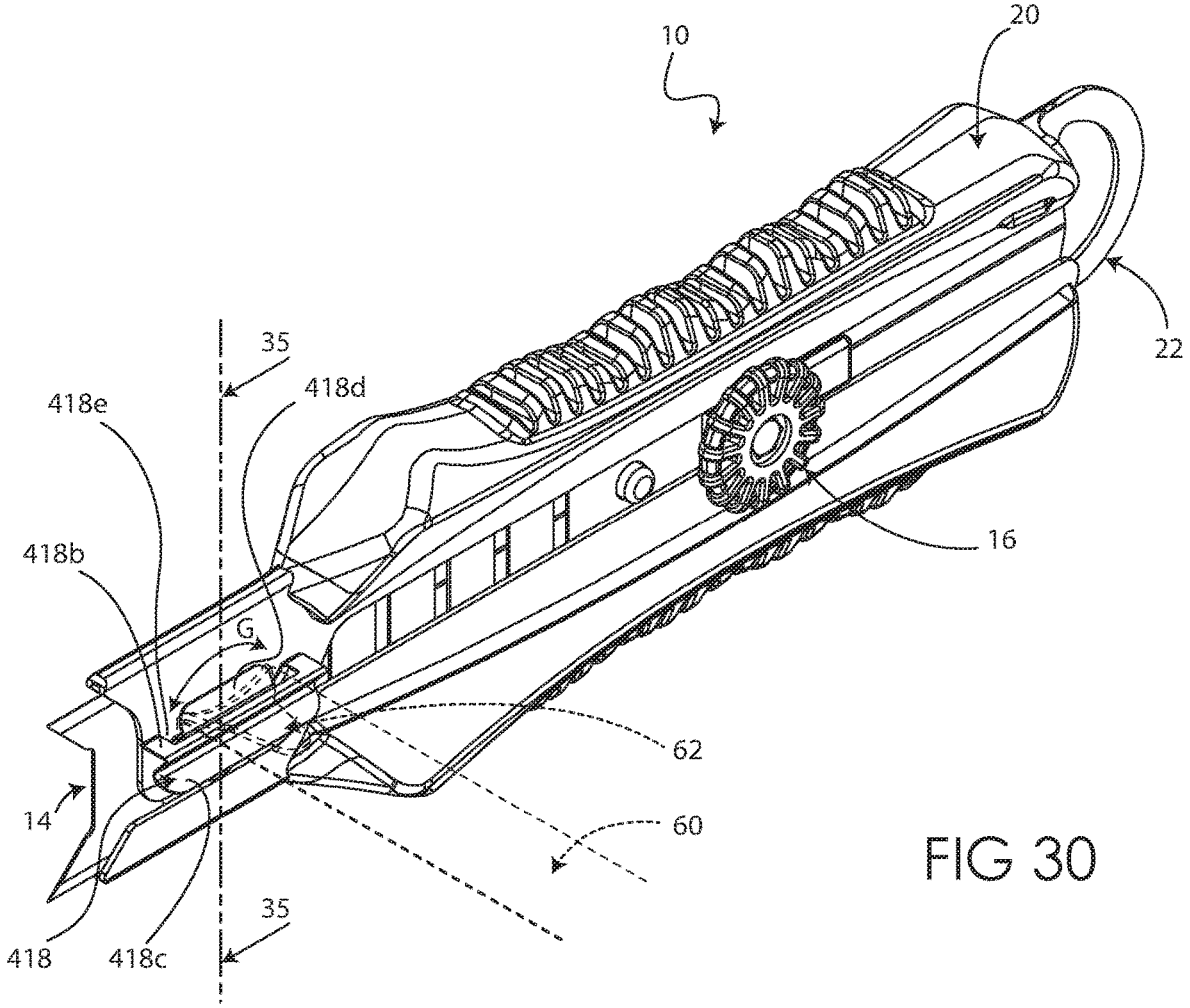
FIG. 30 is a top, front, left side, perspective view of the utility knife of FIG. 1 shown engaged with a fourth embodiment of a tape engagement clip in accordance with an aspect of the present disclosure.
Figure 31:
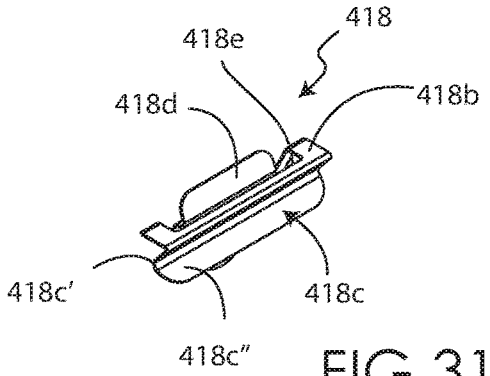
FIG. 31 is a top, front, left side, perspective view of the fourth embodiment tape engagement clip shown in FIG. 30.
Figure 32:
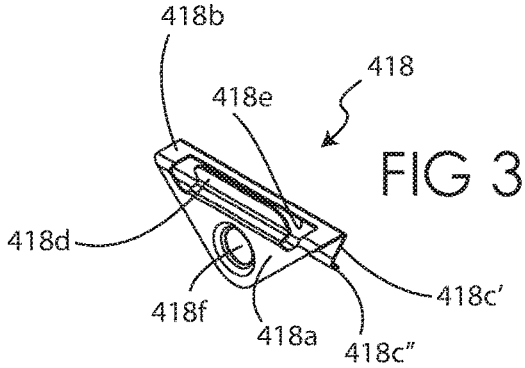
FIG. 32 is a top, rear, right side, perspective view of the tape engagement clip of FIG. 30.
Figure 33:
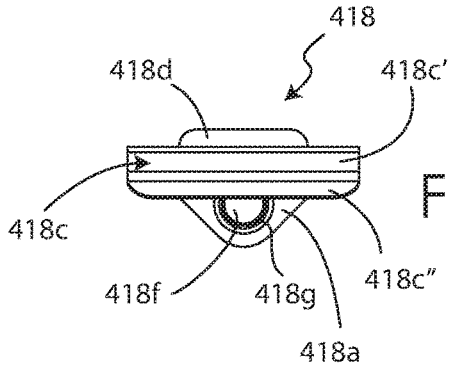
FIG. 33 is a front elevation view of the tape engagement clip of FIG. 30.
Figure 35:
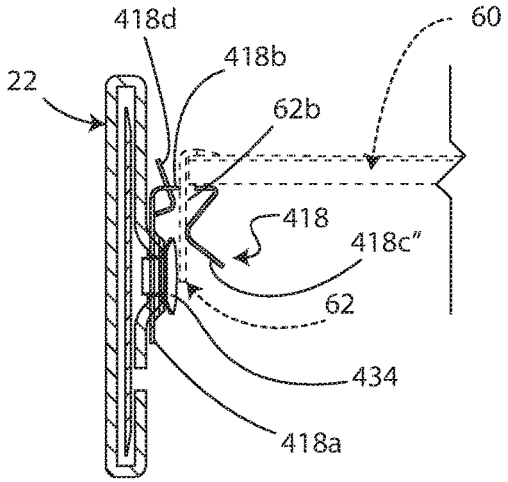
FIG. 35 is a cross-section of the utility knife and tape engagement clip taken along line 35-35 of FIG. 30.

A U-shaped tab 418*d* is cut-out of a first region of first leg 418*a* and a rearward portion of second leg 418*b*. The tab 418*d* is bent generally into an L-shape and is angled rearwardly to extend above second leg 418*b* and the top of first leg 418*a*. The cut-out region of second leg 418*b* defines a passage 418*e* in second leg 418*b* through which an end 62 of a measuring tape 60 may be inserted as shown in FIGS. 30 and 35.

In accordance with an aspect of the disclosure, a through-hole 418*f* is defined in first leg 418*a*. Hole 418*f* extends from inner surface of first leg 418*a* through to an outer surface thereof. A reinforcing ring 418*g* (FIG. 33) circumscribes hole 418*f*. A fastener 434 is inserted through hole 418*f* and into the hole 22*n* (FIG. 3A) to secure tape engagement clip 418 to knife 10. In particular, tape engagement clip 418 may be positioned so that the inner surface of first leg 418*a* is in abutting contact with either or the second side wall 22*f* or the first wall 22*e* of second housing section 22 of knife 10. Tape engaging clip 418 is able to rotate about the shaft of fastener 434, i.e., about an axis that is oriented at right angles to longitudinal axis "Y' of knife 10. The rotation of tape engaging clip 418 is indicated by the arrow "G" in FIG. 30. It will be understood that utility knife 10 with tape engaging clip 418 secured thereto is able to be used in the same manner as has been described earlier herein with respect to any of the knife/tape engaging clips disclosed herein.

Referring now to FIGS. 36-41, utility knife 10 is shown with a fifth embodiment tape engaging clip engaged therewith. Utility knife 10 is identical to the knife 10 illustrated and described with reference to FIGS. 1-19. The fifth embodiment tape engagement clip is indicated by the reference number 518.

FIGS. 37-40 show that tape engagement clip 518 is integrally formed from a single plate of metal that has been bent into a generally L-shaped end product. In particular tape engagement clip 518 includes a vertical first leg 518*a*, a horizontal second leg 518*b*, and a generally vertically-oriented third leg 518*c* that has been bent into an L-shape. In particular, the L-shaped third leg 518*c* has a first region 518*c*' extending inwardly from second leg 518*b*, and a second region 518*c*" extending outwardly from first region 518*c*'. The L-shaped third leg 518*c* extends for a distance outwardly from second housing section 22 and enables a user to readily grasp and manipulate tape engagement clip 418.

An edge of first leg 518*a* is curved to give the first leg 518*a* a more aesthetically pleasing appearance. The curved edge also defines curved corners at either end thereof. These curves help to ensure that few sharp edges are presented on tape engagement clip 518 that might accidentally injure a user during used of the tape engagement clip.

Figure 41:
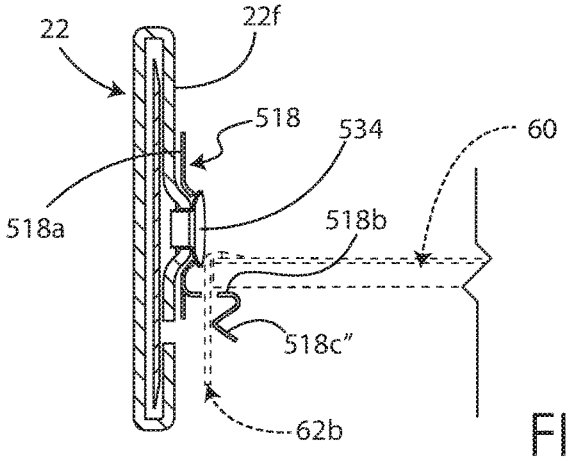
FIG. 41 is a cross-section of the utility knife and tape engagement clip taken along line 41-41 of FIG. 36.

An aperture 518*e* is defined in of second leg 418*b* and defines a passage through which a vertical leg of an end 62 of a measuring tape 60 is inserted to engage a measuring tape 60 thereto as shown in FIGS. 36 and 41.

In accordance with an aspect of the disclosure, a through-hole 518*f* is defined in first leg 518*a*. Hole 518*f* extends from inner surface of first leg 518*a* through to an outer surface thereof. A reinforcing ring 518*g* (FIG. 33) circumscribes hole 518*f*. A fastener 534 is inserted through hole 518*f* and into the hole 22*n* (FIG. 3A) to secure tape engagement clip 518 to knife 10. In particular, tape engagement clip 518 may be positioned so that the inner surface of first leg 518*a* is in abutting contact with either or the second side wall 22*f* or the first wall 22*e* of second housing section 22 of knife 10. Tape engaging clip 518 is able to rotate about the shaft of fastener 534, i.e., about an axis that is oriented at right angles to longitudinal axis "Y' of knife 10. The rotation of tape engaging clip 518 is indicated by the arrow "H" in FIG. 36. It will be understood that utility knife 10 with tape engaging clip 518 secured thereto is able to be used in the same manner as has been described earlier herein with respect to any of the knife/tape engaging clips disclosed herein.

It will be understood that while it has been disclosed herein that the various tape engagement clips are able to be moved from adjacent a first side wall of the second housing section to adjacent the second side wall thereof, in other instances the user is able to simply rotate the tape engagement clip about the axis that is oriented at right angles to the longitudinal axis "Y" so that the knife 10 can be used by a left handed person or by a right handed person. The tape engagement clip can also be rotated about the axis that is oriented at right angles to longitudinal axis "Y" to change a direction in which the user able to simultaneously measure and cut with the knife.

In one aspect, a method of cutting a drywall sheet includes moving a blade member 14 longitudinally along a longitudinal axis "Y" of a utility knife housing 12 from a retracted position (where the first end 14*a* of blade member 14 does not extend beyond first end 22*a* of second housing section 22) to an extended position (where first end 14*a* of blade member 14 does extend outwardly beyond first end 22*a* of second housing section 22). The extended position is shown in FIG. 1. The method further includes providing a first cutting surface and a second cutting surface along opposed first edge 14*c* and second edge 14*d*, respectively, of blade member 14. The method further includes gripping the utility knife housing 12 in either of a first orientation or a second orientation in either of a user's left hand or right hand of the user. The first orientation, for example, may be where the palm of the user's right hand rests on first overmold 24 and the user's fingers of their right hand rest on second overmold 26. The second orientation may be where the palm of the user's right hand rests on second overmold 26 and the user's fingers of their right hand rest on first overmold 24. The first orientation and the second orientation are located 180 degrees apart and moving between the first orientation and the second orientation requires that housing 12 be rotated through 180 degrees about longitudinal axis "Y".

The method further may include cutting a sheet of drywall with the first cutting surface of first edge 14*c* or with the second cutting surface of second edge 14*d*. The particular cutting surface utilized depends on whether housing 12 is in the first orientation or second orientation as described above.

The method further includes gripping utility knife 10 in a user's left hand or right hand by resting a palm of the user's left hand or right hand on a first overmold 24 provided on a first wall 20*c* of the utility knife housing 12; and resting the fingers of the user's left hand or right hand on a second overmold 26 provided on the second wall 20*d* of the utility knife housing 12. Alternatively, gripping utility knife 10 may comprise resting a palm of the user's left hand or right hand on second overmold 26 provided on second wall 20*d* of housing 12 and resting the user's finger of the user's left hand or right hand on first overmold 24 provided on first wall 20*c* of housing 12.

The method further includes fabricating first overmold 24 and the second overmold 26 from a resilient material. The resilient material may be rubber. The fabricating includes forming one first overmold 24 and second overmold 26 as a series of alternating ribs 24*a*, 26*a* and spaces 24*b*, 26*b*. The fabricating further comprises utilizing ribs 24*a*, 26*a* of different heights along a length of the associated first overmold 24 and the second overmold 26 and arranging the ribs 24*a*, 26*a* of different heights into a series of hills and valleys that resemble a sine wave as seen in FIG. 4. The fabricating further includes curving first wall 20*c* and second wall 20*d*, and positioning first overmold 24 in the curve of first wall 20*c* and positioning second overmold 26 in the curve of second wall 20*d*.

The fabricating further includes forming housing 12 to include a first side wall and an opposed pair of second side wall sections. The housing 12 has having a midline "M" (FIG. 4) that is substantially parallel to longitudinal axis "Y". Housing 12 is substantially symmetrical about midline "M". The method further comprises, arranging the first wall 20*c* and second wall 20*d*, and the series of hills and valleys of the first overmold 24 and the second overmold 26 as mirror images of each other. The method further includes providing an inverted V-shaped projection 20*j*, 20*k* in the first wall 20*c* and second wall 20*d*, respectively, forwardly of each the first overmold 24 and the second overmold 26; and positioning a pad of the user's thumb 52 (FIG. 14) on a downward slope 20J', 20K' of one of the projection 20*j*, 20*k*, depending on whether the housing 12 of knife 10 is in the first orientation or second orientation.

The method may further include forming the utility knife housing 12 as a first housing section 20 and a second housing section 22; receiving a portion of the second housing section 22 in an interior cavity 20*h* defined by the first housing 20; extending a leading end of the second housing section 22 outwardly from an opening to the interior cavity 20*h*; and receiving the blade member 14 within an interior chamber 22*h* defined by second housing section 22.

In another aspect, the method may comprise positioning a free end 62 of a measuring tape 60 adjacent one of a first side wall 22*e* and a second side wall 22*f* of a leading end of the utility knife housing 12. The positioning may further include securing the free end 62 of the measuring tape 60 to the leading end of the utility knife housing 12. The securing may be temporary in that the free end of the measuring tape 60 may be disengaged from its engagement with the utility knife housing. The securing may include engaging a tape engaging clip 18 with one of the first side wall 22*e* and the second side wall 22*f* of the leading end of the utility knife housing 12. The securing may further include inserting a vertical leg 62*b* of the free end 62 of the measuring tape 60 into a passage 18*g* defined in the tape engaging clip 18. (Disengaging measuring tape 60 from knife 10 includes removing vertical leg 62*b* of free end 62 from the passage 18*g*. The method may further include extending a length of measuring tape 60 from a measuring tape housing and positioning the measuring tape housing a distance from the free end 62, and maintaining the measuring tape housing the distance away from the free end 62 while cutting the drywall sheet with one or the other of the first cutting edge and the second cutting edge.

The method may further include rotating the tape engaging clip 18 about an axis oriented at right angles to a longitudinal axis "Y" of the utility knife housing 12. The axis oriented at right angles to longitudinal axis "Y" extends along a shaft of fastener 34 that is utilized to secure tape engaging clip 18 to housing 12. The rotating of tape engaging clip 18 is undertaken when selecting to change from using a first cutting surface of the first edge 14*c* of the blade member 14 to using a second cutting surface of the second edge 14*d* of the blade member 14, and vice versa. The method further comprises rotating the utility knife housing through 180 degrees about the longitudinal axis "Y" after selecting which of the first cutting surface and the second cutting surface to utilize to cut an article such as a drywall sheet.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

In the foregoing description, certain terms have been used for brevity, clarity, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A utility knife comprising:

a housing having:

a first housing section defining an interior cavity accessible through an opening;

a second housing section receivable within the interior cavity of the first housing section, said second housing section having a side wall with first end and an opposed second end, and a longitudinal axis extending between the first end and the second end;

wherein the first end of the second housing section is U-shaped and includes a first tip laterally spaced from a second tip, wherein the first tip and the second tip are V-shaped and extend longitudinally outwardly in a same direction as one another and away from the second end of the second housing section; and a blade member operatively engaged with the second housing section;

wherein the blade member comprises a planar body having a first end, an opposed second end, and a longitudinal axis extending therebetween;

wherein a first cutter tip and a second cutter tip are provided at the first end of the planar body;

wherein the first cutter tip and the second cutter tip are laterally spaced from one another and extend longitudinally in a same direction as one another and away from the second end of the planar body; and wherein one or both of the blade member and the second housing section is selectively movable relative to the first housing section so as to extend at least the first end of the blade member outwardly beyond the opening in the first housing section and beyond the first tip and the second tip of the second housing section in order to perform a cutting operation with one of the first cutter tip and the second cutter tip.

2. The utility knife according to claim 1, wherein the first housing section includes a first wall and a second wall, wherein the first housing section has a first end and a second end and a longitudinal axis extending therebetween, and wherein the first housing section has a midline that is parallel to the longitudinal axis; wherein each of the first wall and the second wall defines a projection having an apex and an angled surface that extends from the apex towards the first end of the first housing section, wherein the apex of the projection extends outwardly for a greater distance from the midline than a rest of the first wall and the second wall, respectively.

3. The utility knife according to claim 1, wherein the first housing section further comprises a first wall opposite a second wall, and wherein:

a first overmold is provided on the first wall; and a second overmold is provided on the second wall; and wherein each of the first overmold and the second overmold comprises a resilient material.

4. The utility knife according to claim 3, wherein each of the first overmold and the second overmold has alternating ribs and spaces, wherein the ribs are of varying heights and are arranged as a series of undulating hills and valleys.

5. The utility knife according to claim 1, further comprising a tape engaging clip provided on one of the first side wall; and the second side wall of the second housing section proximate the first end thereof, wherein the tape engaging clip defines a passage therein, and wherein the passage is adapted to selectively receive a portion of a free end of a measuring tape therein.

6. The utility knife according to claim 5, further comprising a fastener which pivotally engages the tape engaging clip with one of the first side wall and the second side wall of the second housing section, wherein the tape engaging clip is selectively rotatable about an axis that is oriented at right angles to the longitudinal axis of the second housing section.

7. The utility knife according to claim 1, wherein the planar body of the blade member has a midline that is equidistant from opposed side edges of the planar body, wherein the opposed side edges extend between the first end and the second end of the planar body; and wherein the planar body is symmetrical about the midline.

8. The utility knife according to claim 1, wherein the the first cutter tip and second cutter tip are identical in shape.

9. The utility knife according to claim 8, wherein the first cutter tip and the second cutter tip are V-shaped.

10. The utility knife according to claim 8, wherein the first cutter tip and the second cutter tip are arranged on the blade member as mirror images of each other.

11. The utility knife according to claim 1, wherein the planar body of the blade member further includes a first side edge and an opposed side edge that extend between the first end of the blade member and the second end of the blade member; and wherein at least a portion of each of the first side edge and the second side edge comprises a cutting surface.

12. The utility knife according to claim 1, wherein the first cutter tip and the second cutter tip of the blade member are laterally separated from one another by a U-shaped recess.

13. The utility knife according to claim 1, further comprising a locking mechanism operative to selectively secure the blade member in a fixed position relative to the second housing section.

14. The utility knife according to claim 1, wherein the second housing section defines an interior chamber accessible through an opening defined in the first end of the housing section, and wherein the second end of the planar body of the blade member is received into the interior chamber through the aperture.

15. The utility knife according to claim 1, wherein the blade member is movable between an extended position and a retracted position relative to the second housing section; and wherein when the blade member is in the extended position the first cutter tip extends outwardly beyond the first tip of the second housing section and the second cutter tip extends outwardly beyond the second tip of the second housing section; and wherein when the blade member is in the retracted position, the first tip of the second housing section extends outwardly beyond the first cutter tip of the blade member, and the second tip of the second housing section extends outwardly beyond the second cutter tip of the blade member.

16. The utility knife according to claim 1, wherein the blade member is comprised of a plurality of blade segments which are identical to one another, wherein adjacent blade segments are separated from one another by a line of weakness, and wherein each blade segment includes a leading end identical to the first end of the blade member, and wherein each blade segment is separately removable from a rest of the blade member.

17. The utility knife according to claim 1, wherein the housing has a first end and a second end and a longitudinal axis extending therebetween, wherein the housing is selectively positionable in one of a first orientation and a second orientation when performing a cut during a cutting operation with the utility knife, wherein when the housing is in the first orientation, a first cutting surface on the first cutter tip is presented for performing the cut, and wherein when the housing is in the second orientation, a second cutting surface on the second cutter tip is presented for performing the cut.

18. A method of cutting a drywall sheet comprising:

providing a utility knife comprising a utility knife housing, a blade member, and a locking mechanism; wherein the utility knife housing comprises a first housing section defining an interior cavity accessible through an opening; a second housing section receivable within the interior cavity of the first housing section, said second housing section having a side wall with first end and an opposed second end, and a longitudinal axis extending between the first end and the second end; wherein the first end of the second housing section is U-shaped and includes a first tip laterally spaced from a second tip, wherein the first tip and the second tip extend longitudinally outwardly in a same direction as one another and away from the second end of the second housing section; and the blade member operatively engaged with the second housing section; wherein the blade member comprises a planar body having a first end, an opposed second end, and a longitudinal axis extending therebetween; wherein a first cutter tip and a second cutter tip are provided at the first end of the planar body; wherein the first cutter tip and the second cutter tip are laterally spaced from one another and extend longitudinally in a same direction as one another and away from the second end of the planar body; wherein the first cutter tip includes a first cutting surface and the second cutter tip includes a second cutting surface, and wherein the first cutting surface and the second cutting surface are located on opposite side edges of the planar body from one another;

selectively moving one or both of the blade member and the second housing section relative to the first housing section;

moving the blade member longitudinally along a longitudinal axis of the utility knife housing from a retracted position to an extended position;

extending at least the first end of the blade member outwardly beyond the opening in the first housing section and beyond the first tip and the second tip of the second housing section;

gripping the utility knife housing in either of a first orientation or a second orientation in either of a user's left hand or right hand of the user;

cutting the drywall sheet with a first cutting surface of the first cutter tip when the utility knife housing is held in the first orientation and cutting the drywall sheet with a second cutting surface of the second cutter tip when the utility knife housing is held in the second orientation; and rotating the utility knife housing through 180 degrees to move the utility knife housing between the first orientation and the second orientation.

19. The method according to claim 18, further comprising:

securing a free end of a measuring tape to a tape engagement clip provided on a leading end of the second housing section of the utility knife housing; and pivoting the tape engagement clip through 180 degrees when the utility knife housing is moved from the first orientation to the second orientation.

* * * * *